US007475570B2

(12) United States Patent
Zorini

(10) Patent No.: US 7,475,570 B2
(45) Date of Patent: Jan. 13, 2009

(54) TEXTILE MACHINE WITH YARN FEEDING CONTROL

(76) Inventor: Luigi Omodeo Zorini, c/o Comez S.p.A. - Via Enrico Fermi, 5 P.O. Box 5, 27024 Cilavegna (Pavia) (IT)

( * ) Notice: Subject to any disclaimer, the term of this patent is extended or adjusted under 35 U.S.C. 154(b) by 400 days.

(21) Appl. No.: 11/342,084

(22) Filed: Jan. 27, 2006

(65) Prior Publication Data

US 2006/0169003 A1 Aug. 3, 2006

(30) Foreign Application Priority Data

Jan. 31, 2005 (EP) ..... 05425040
Feb. 7, 2005 (EP) ..... 05425055

(51) Int. Cl.
*D04B 27/22* (2006.01)

(52) U.S. Cl. ..... 66/210

(58) Field of Classification Search ..... 66/210, 66/212, 209; 139/105
See application file for complete search history.

(56) References Cited

U.S. PATENT DOCUMENTS 3,780,541 A * 12/1973 Haynes ..... 66/125 R
4,884,597 A * 12/1989 Tamura et al. ..... 139/102
5,152,158 A * 10/1992 Wirth ..... 66/212
5,163,307 A * 11/1992 Jahn et al. ..... 66/212
5,375,435 A * 12/1994 Gille et al. ..... 66/211
5,461,881 A 10/1995 Handel et al.
5,524,461 A 6/1996 Nielsen et al.
6,640,591 B1 * 11/2003 Haban ..... 66/210

FOREIGN PATENT DOCUMENTS

DE 44 26 199 A1 3/1995
DE 44 39 907 A1 5/1996
DE 201 11 860 U1 9/2001
JP 2000328408 11/2000

* cited by examiner

*Primary Examiner*—Danny Worrell
(74) *Attorney, Agent, or Firm*—Pearne & Gordon LLP

(57) ABSTRACT

A textile machine comprising a main shaft (10) to be driven in rotation, and a sensor (20) to detect at least one angular position (PA) of said shaft and generate a corresponding reference signal (SR); the machine (1) further comprises weaving members (30) to make a textile product (30), at least one beam (50) on which a yarn (60, 61, 63, 64) to be fed to the weaving members (30) for manufacture of the textile product (40) is wound, and an actuator to drive the beam (50) in rotation and unwind the yarn (60, 61, 63, 64). The machine (1) further comprises a controller connected to the sensor (20) and an actuator depending on the reference signal (SR).

49 Claims, 16 Drawing Sheets

TEXTILE MACHINE WITH YARN FEEDING CONTROL

It is known that different types of textile machines, such as the crochet galloon machines, needle looms and two-bed warp knitting machines, have a plurality of weaving members that are fed with suitable yarns and that, by moving in synchronism with each other, enable a predetermined textile product to be obtained.

The yarns supplied to said weaving members can be unwound from rollers positioned in the vicinity of the machine, which are generally called "beams"; for the purpose of optimising operation of the machine and quality of the finished product, use of a control system to adjust the rotation speed of the beams is provided, said adjustment particularly aiming at keeping a constant tension and avoiding breakage of the yarns used.

In more detail, the machines of known type are provided with one or more sensors, to detect tension of the yarns supplied to the weaving members; said sensors can be both of mechanical and electromechanical type and also of the magnetic type. Depending on the detected tension, a control unit carries out adjustment of the rotation speed of the beam.

Therefore, if a high tension is for instance detected, the rotation speed of the beam is increased, so as to meet the machine "requirements"; if, on the contrary, the detected tension is low, the rotation speed of the beam is decreased, to prevent the machine from being uselessly fed with an excessive amount of yarn, thereby causing deterioration of the quality of the finished product.

However, the control systems briefly described above have different operating drawbacks.

First of all, the rotation speed of the beams does not take into account the type of product to be made, and it is not synchronised with the movements of the weaving members designed to manufacture the finished product; therefore the quality of the finished product is greatly worsened.

In addition, following quick variations in the yarn tension (due to wide travels of one or more weaving members, for example), the control loop taking the yarn tension as the reference parameter can have a response speed that is not sufficient to follow said variations.

Consequently the risk that one or more yarns will break exactly due to quick movements of the weaving members is not negligible, which will impair operation of the whole machine and quality of the finished product.

It is an aim of the present invention to provide a textile machine in which the feeding beams rotate in synchronism with the weaving members of the machine, so as to minimise the risk of breakage of the yarns themselves.

It is a further aim of the present invention to make available a textile machine capable of providing a finished (or semifinished product) of high quality in particular having an optimal tension of the yarns forming it.

The foregoing and further aims are substantially achieved by a textile machine with yarn feeding control in accordance with the features set out in the appended claims.

Further features and advantages will become more apparent from the detailed description of a preferred embodiment given for purposes of illustration but not of limitation, of a textile machine with yarn feeding control in accordance with the present invention.

This description will be set out hereinafter with reference to the accompanying drawings given by way of non-limiting example as well, in which.

Figure 1:
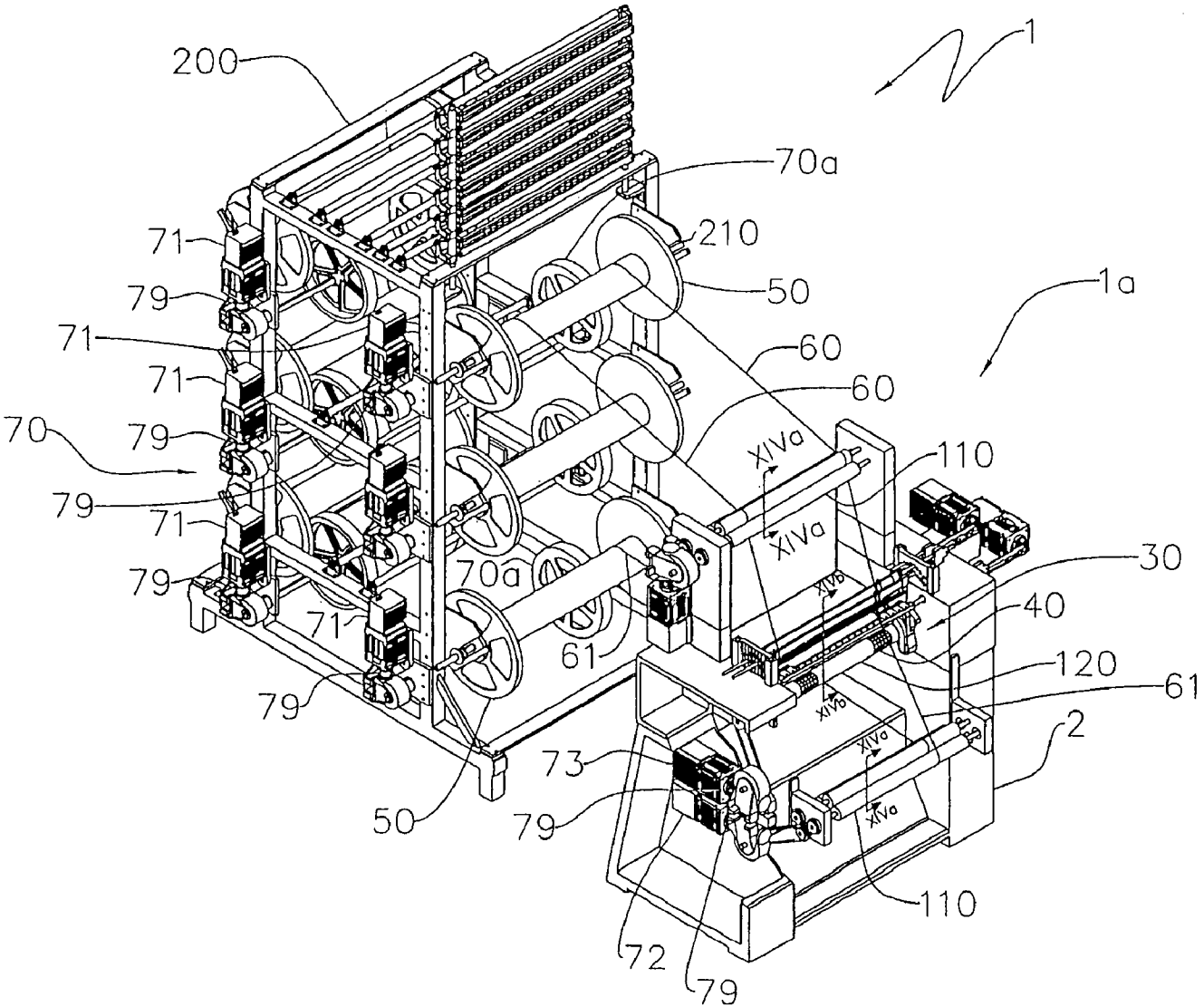
FIG. 1 is a diagrammatic perspective view of a first textile machine in accordance with the invention, with some parts removed for a better view of others.
Figure 2:
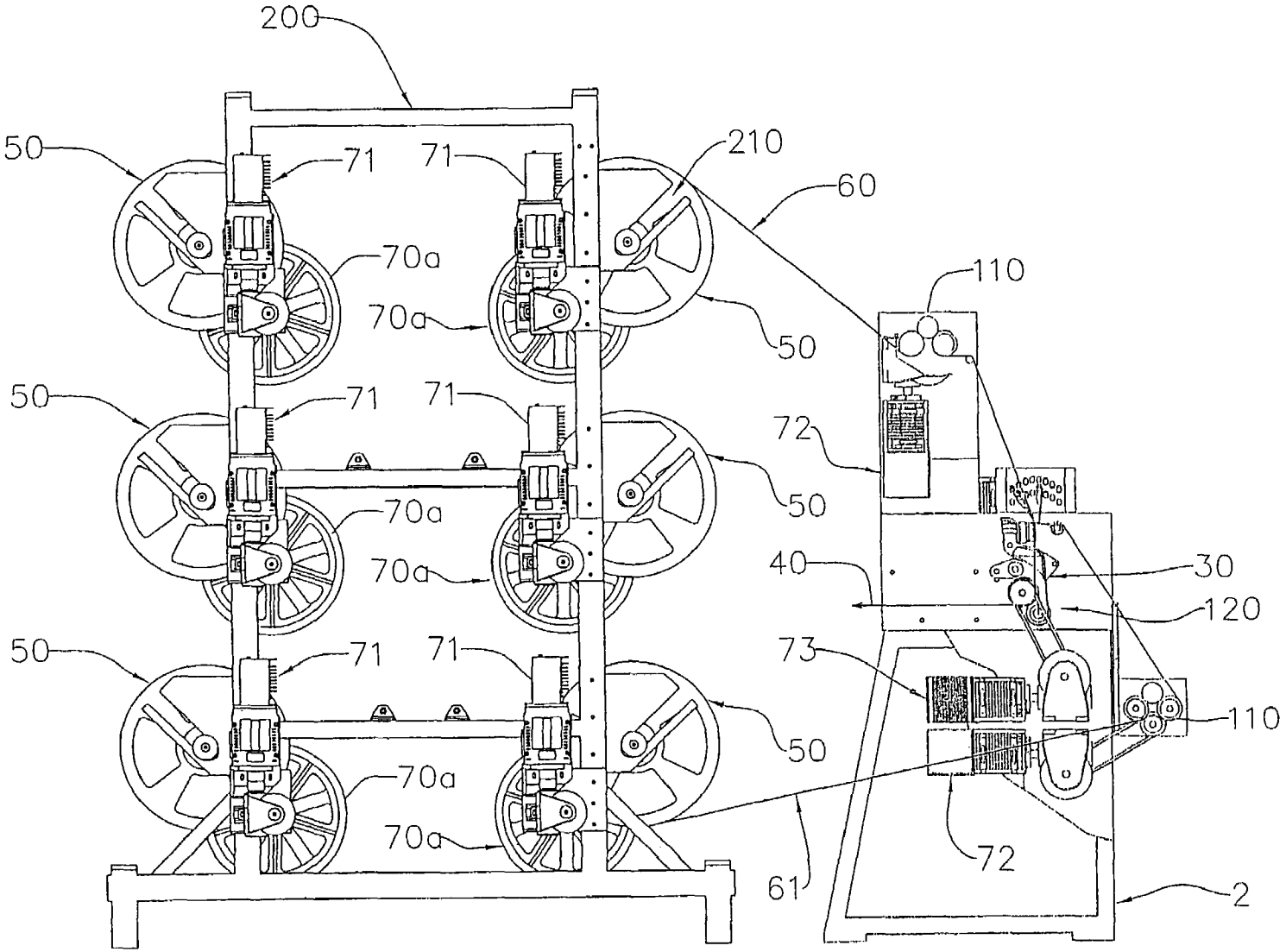
FIG. 2 is a diagrammatic side view of the machine seen in FIG. 1.
Figure 3:
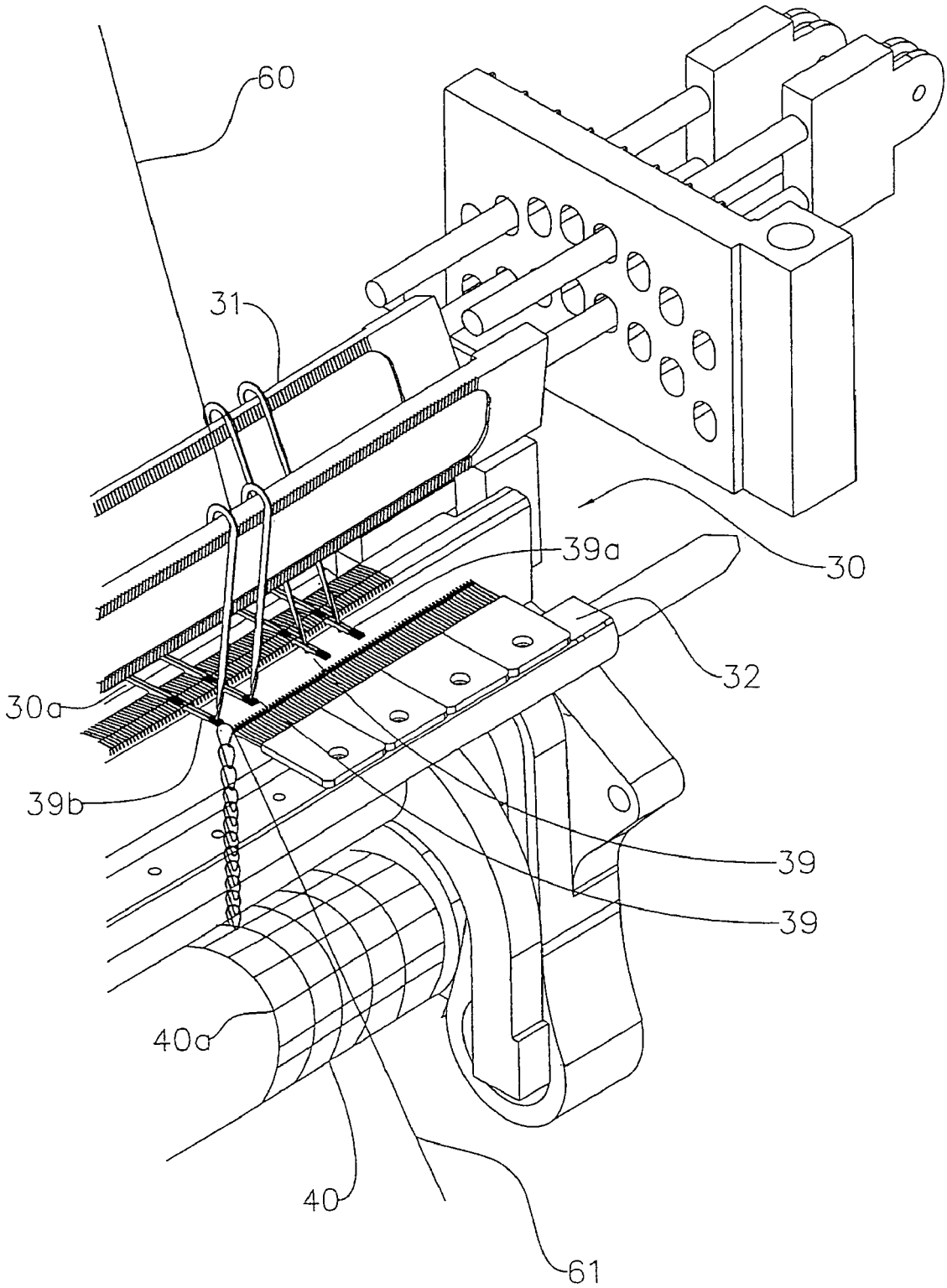
FIG. 3 shows a detail of the machine in FIG. 1.
Figure 4:
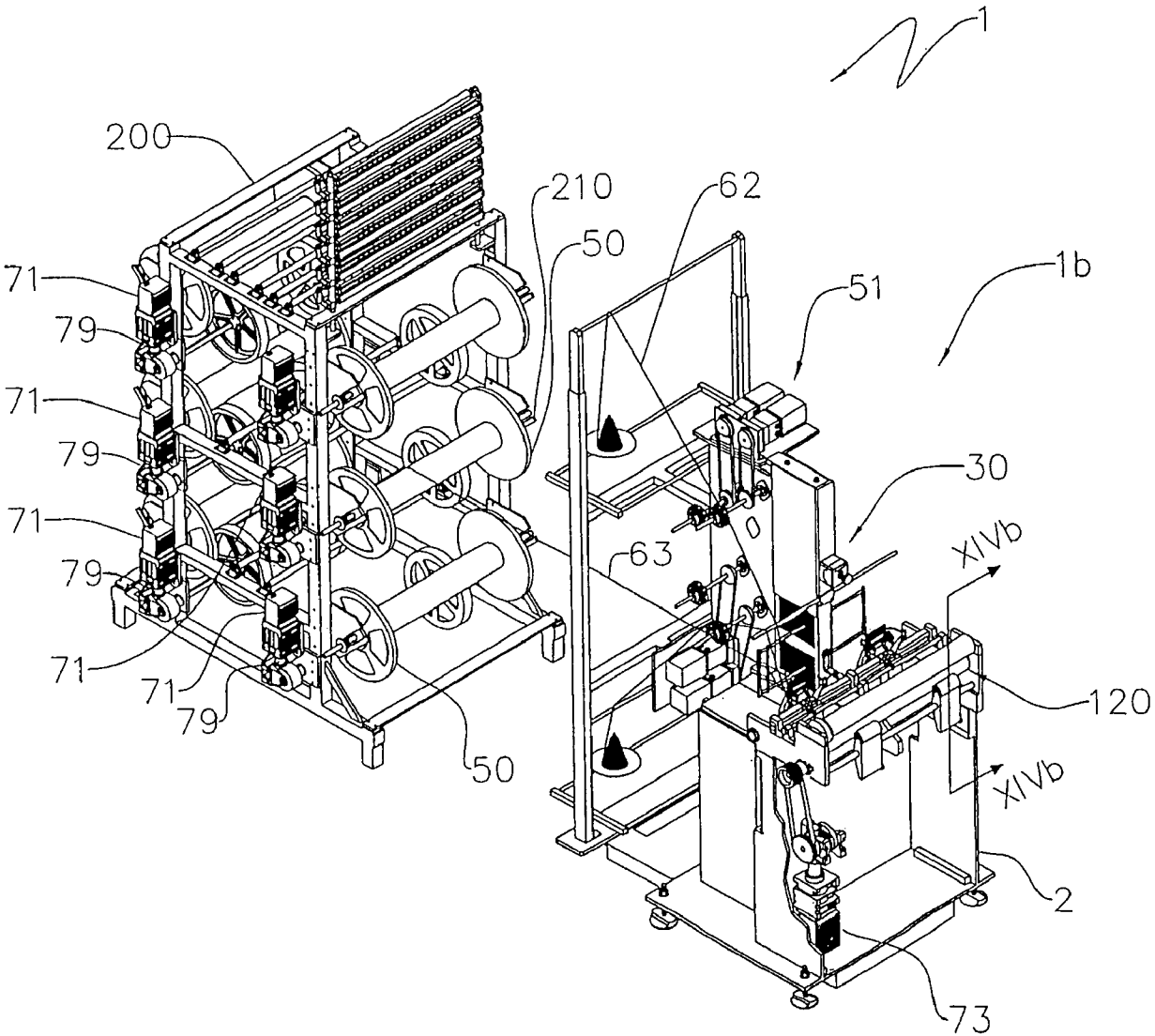
FIG. 4 is a diagrammatic perspective view of a second textile machine in accordance with the invention, with some parts removed for a better view of others.
Figure 5:
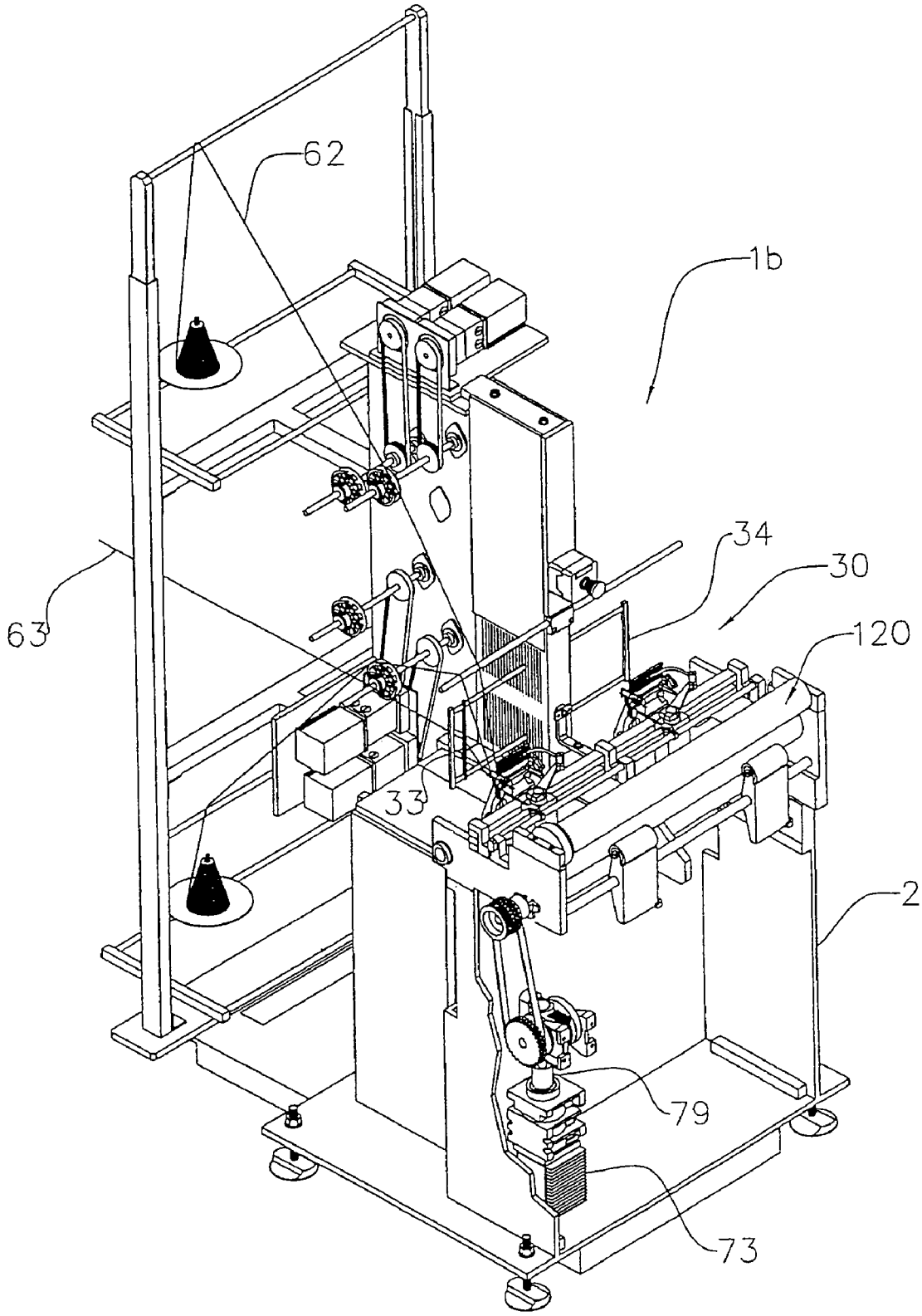
FIG. 5 shows part of the machine in FIG. 4 to an enlarged scale.
Figure 8:
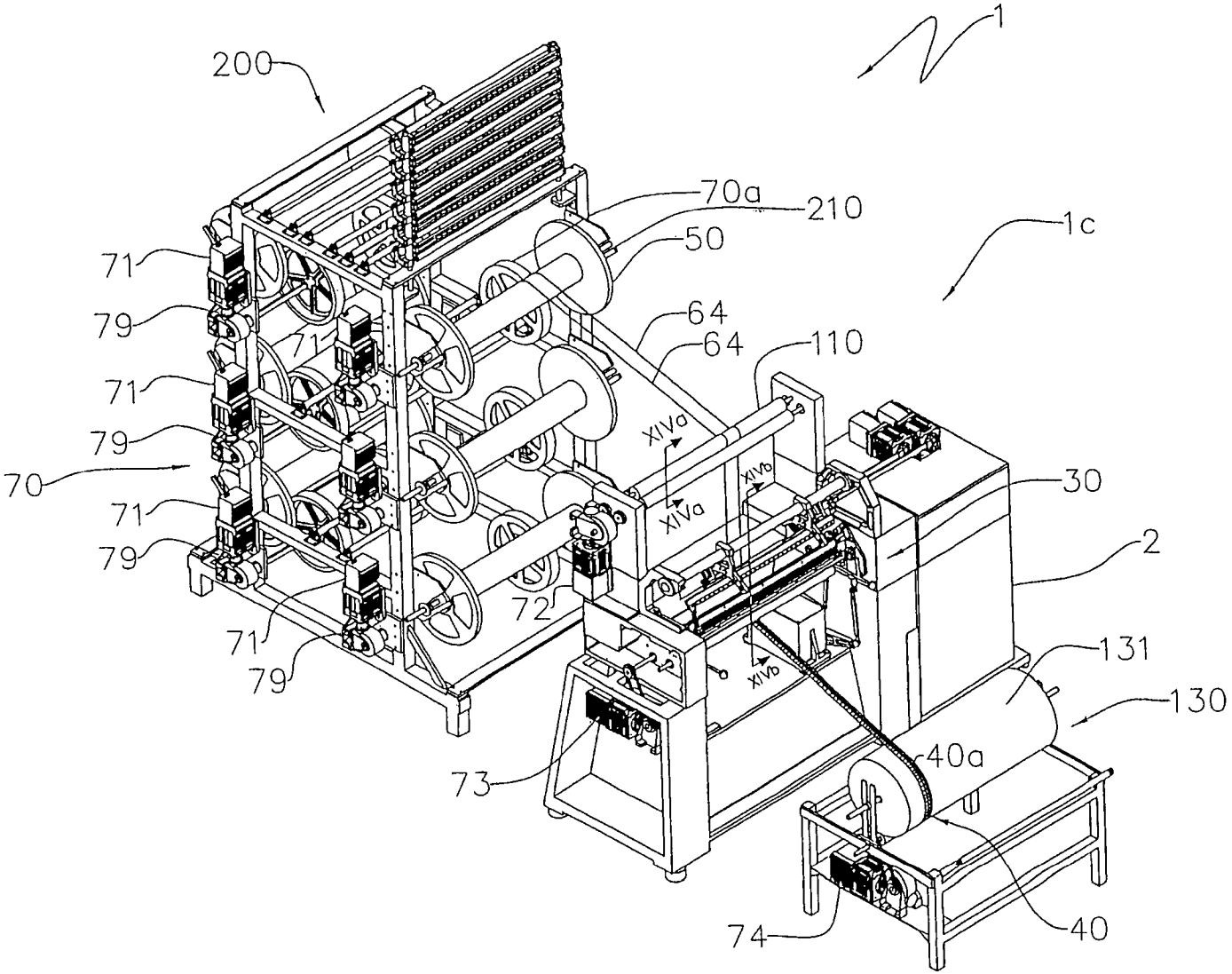
FIG. 8 is a diagrammatic perspective view of a third textile machine in accordance with the invention, with some parts removed for a better view of others.
Figure 9:
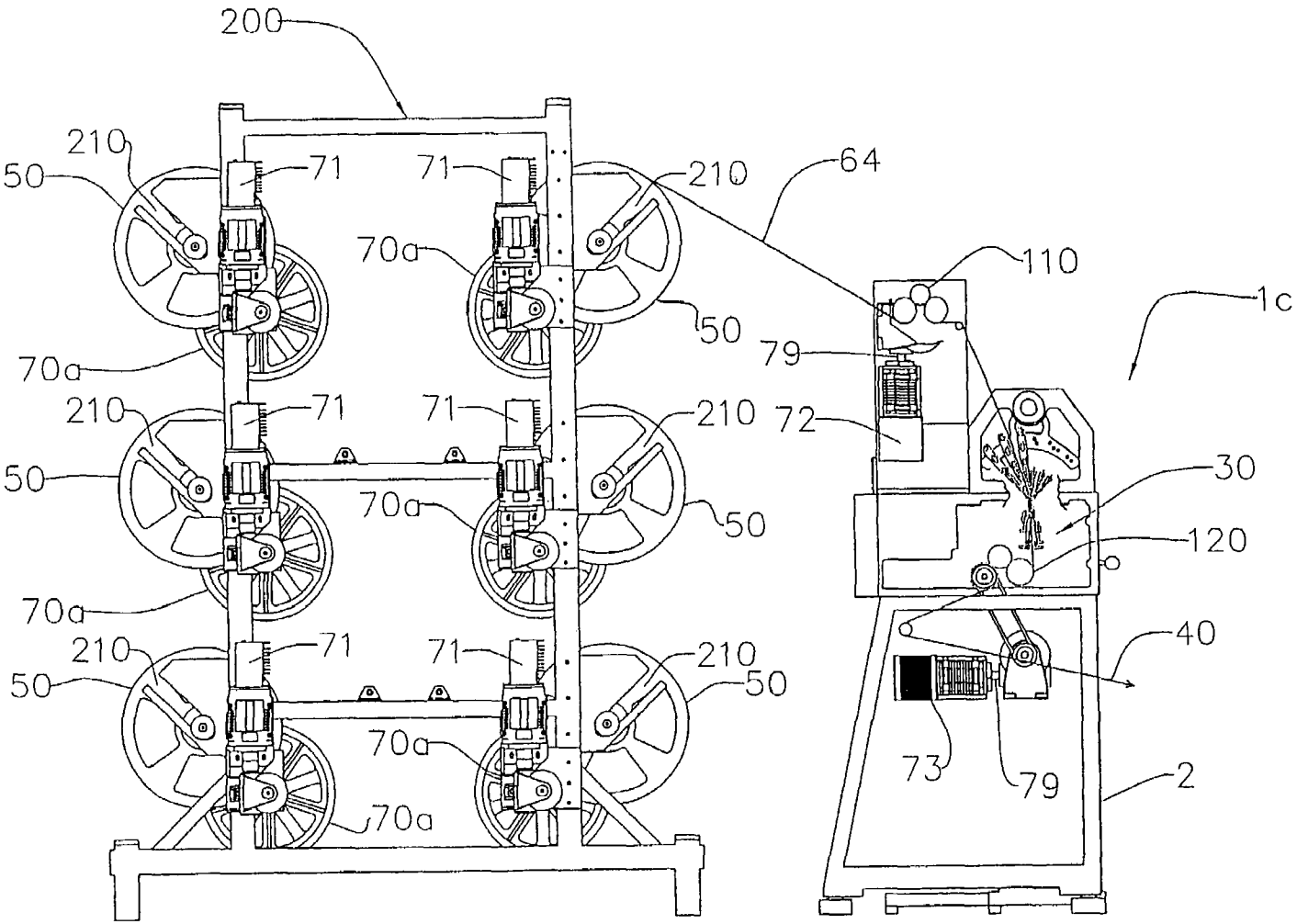
FIG. 9 is a diagrammatic side view of the machine in FIG. 8.
Figure 10:
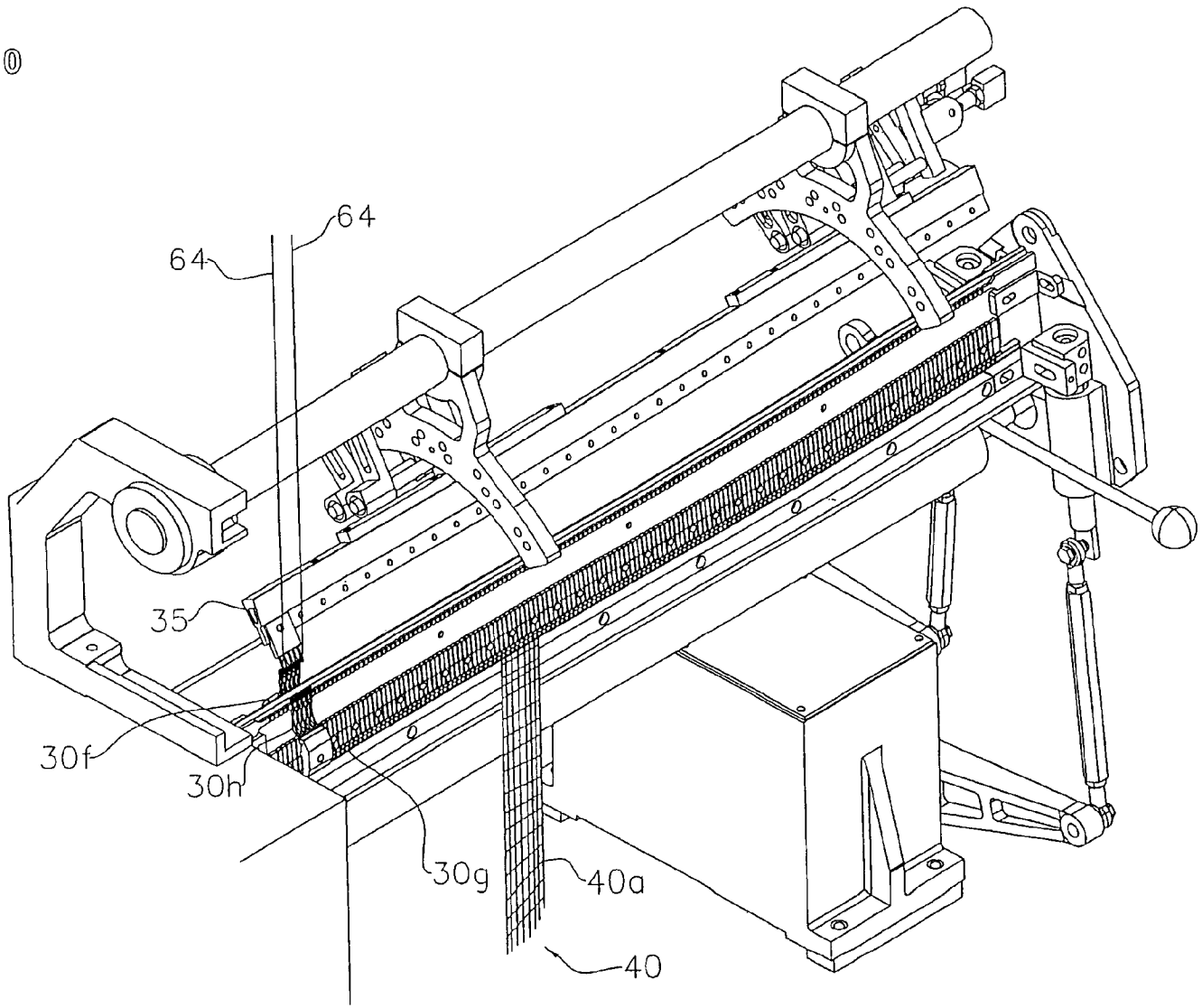
FIG. 10 shows a detail of the machine in FIG. 8.
Figure 14A:
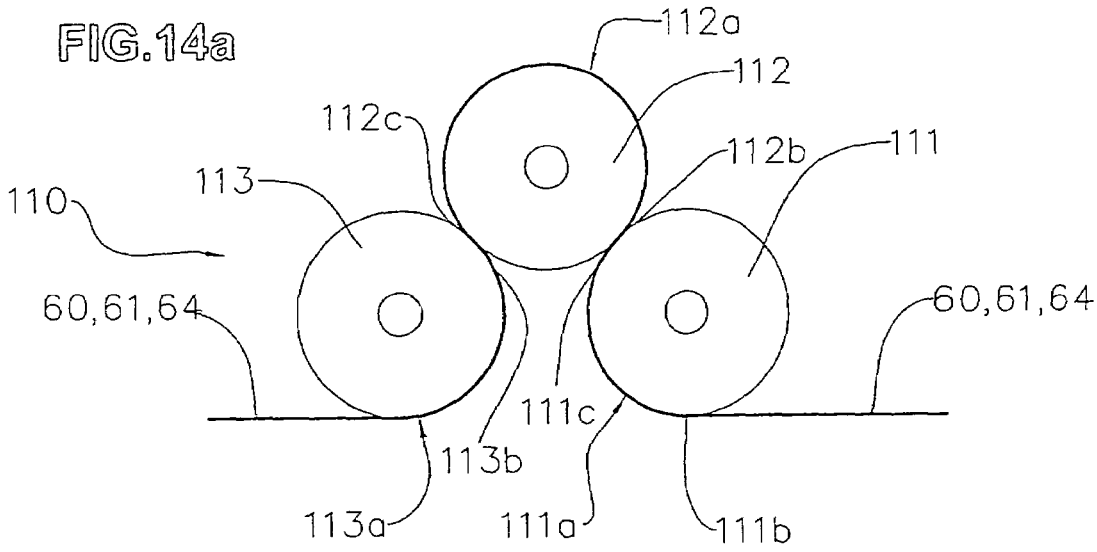
Figure 14B:
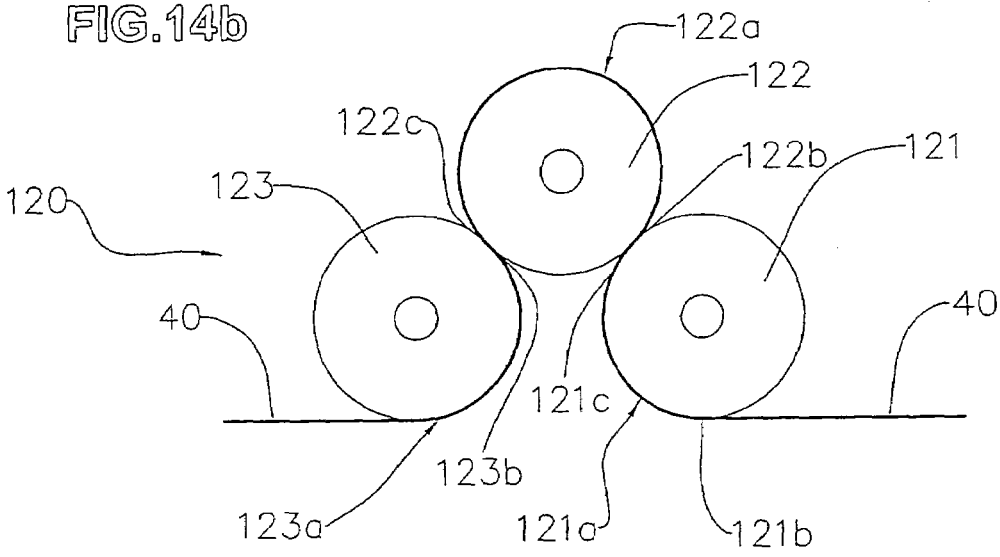
Figure 15A:
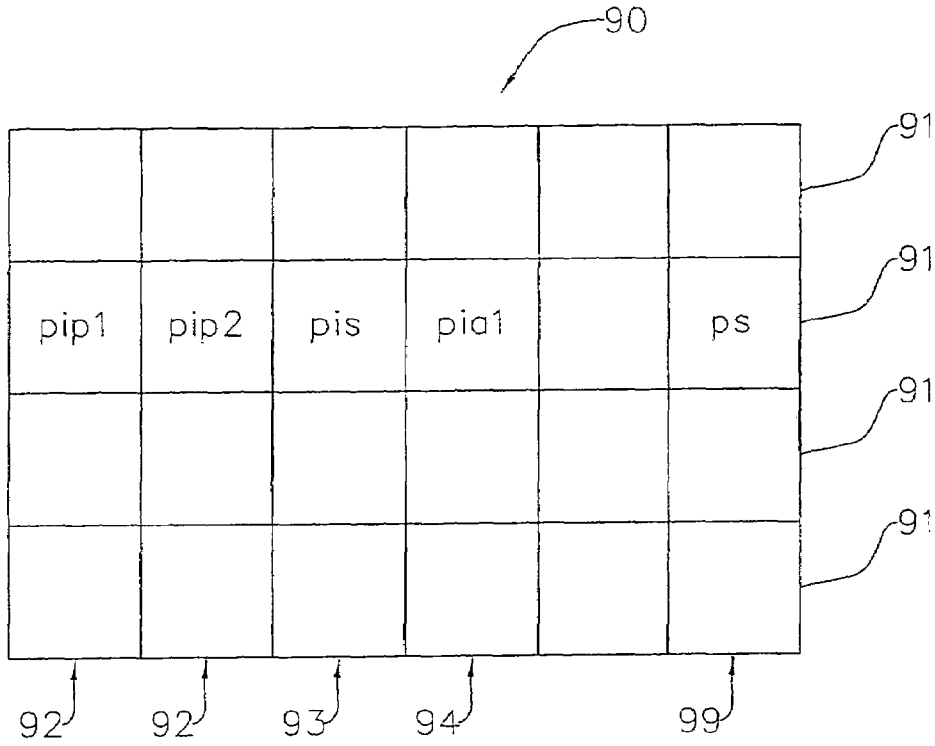
Figure 15B:
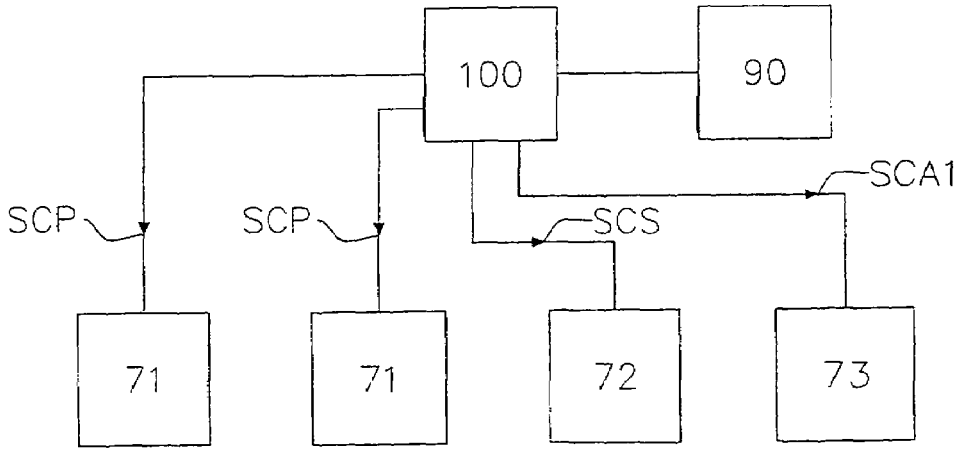
Figure 16A:
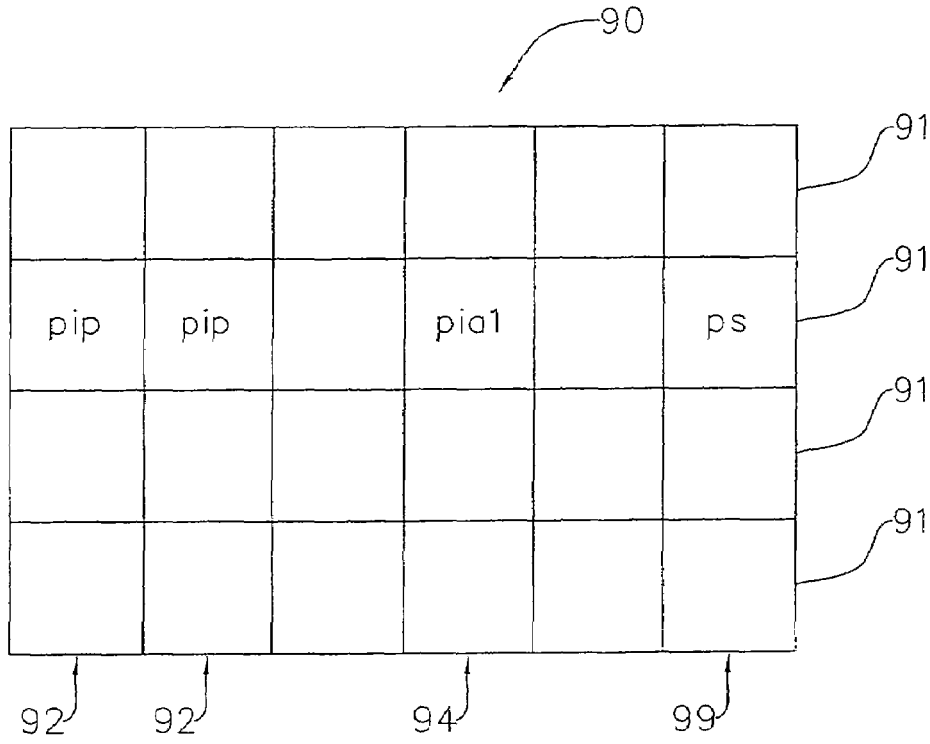
Figure 16B:
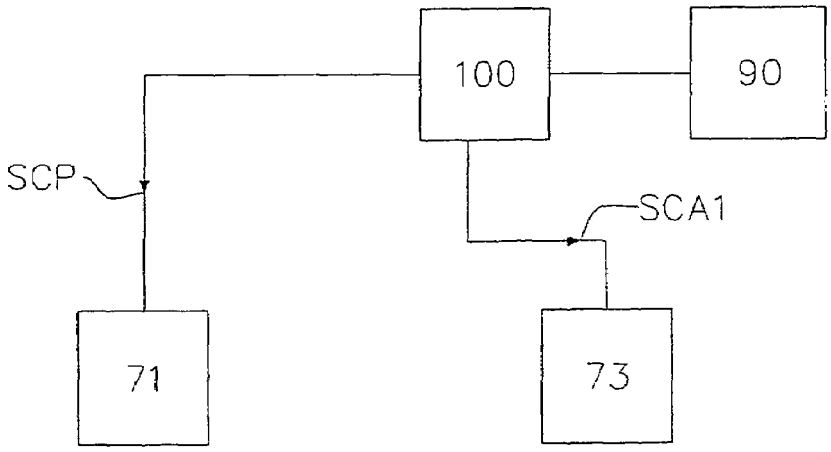
Figure 17A:
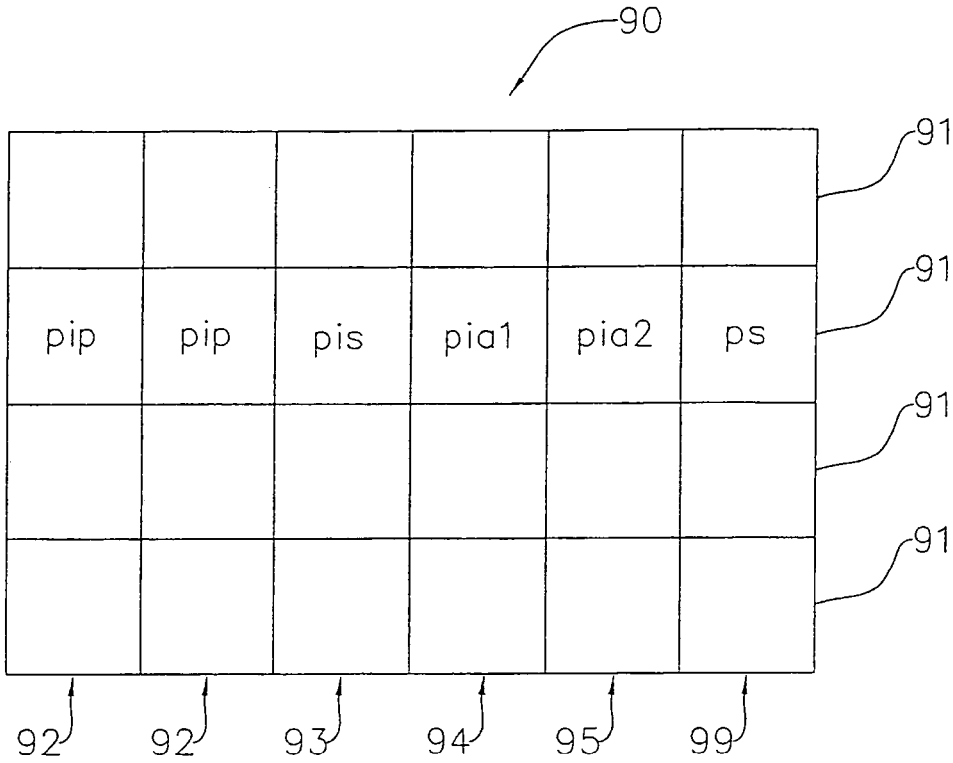
Figure 17B:
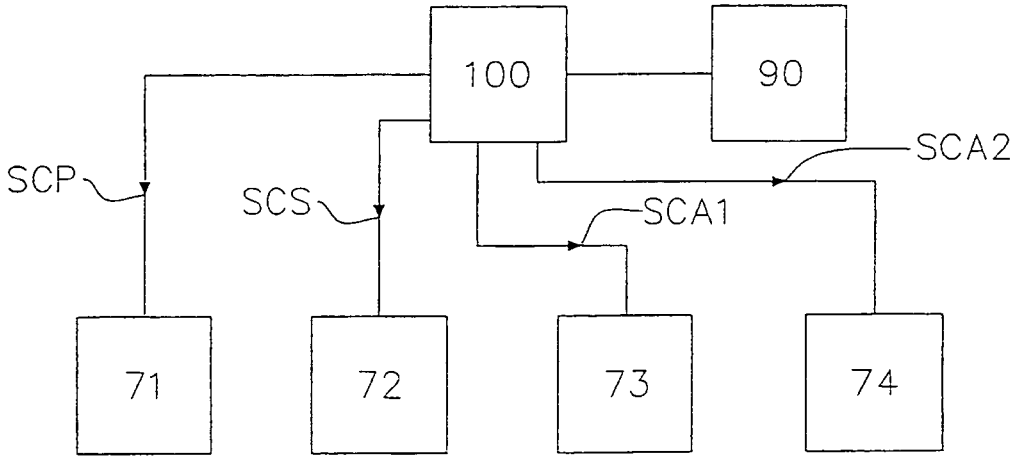

FIGS. 14*a*-14*b* are diagrammatic side views taken along planes XIVa-XIVa and XIVb-XIVb respectively, of members present in the machines in FIGS. 1, 4 and 8;

FIG. 15*a* shows the logic structure of a memory used in a first embodiment of the control system applied to the machine in FIGS. 1-3;

FIG. 15*b* is a block diagram of the first embodiment of the control system applied to the machine in FIGS. 1-3;

FIG. 16*a* shows the logic structure of a memory used in a first embodiment of the control system applied to the machine in FIGS. 4-7;

FIG. 16*b* shows the block diagram of the first embodiment of the control system applied to the machine in FIGS. 4-7;

FIG. 17*a* shows the logic structure of a memory used in a first embodiment of the control system applied to the machine in FIGS. 8-10;

FIG. 17*b* shows the block diagram of the first embodiment of the control system applied to the machine in FIGS. 8-10.

With reference to the accompanying drawings, a textile machine with yarn feeding control in accordance with the present invention has been generally identified with reference numeral 1.

As above mentioned, the present invention can apply to different types of textile machines; in the following description reference will be specifically made to a crochet galloon machine 1*a*, a needle loom 1*b* and a two-bed warp knitting machine 1*c*. It is however to be noticed that the present invention can be put into practice on any textile machine that is provided with one or more beams from which the yarns to be used for making the desired product are unwound, such as warp knitting machines, flat knitting machines and looms in general.

The textile machine first of all comprises one or more weaving members 30 for manufacture of a textile product 40.

Where a crochet galloon machine (FIGS. 1-3) is concerned, the weaving members 30 can comprise one or more needle bars 30*a*, one or more guide bars 32 and one or more carrier slide bars 31.

Through kinematic mechanisms of known type, possibly operated by suitable electric motors, said bars 30*a*, 31, 32 are moved in synchronism with each other, so that the eye-pointed needles load the warp yarns 61 on the needles thereby defining a series of chains, while the threading tubes dispose the weft yarns 60 transversely of the warp yarns 61, so that the weft yarns 60 themselves interlace with the chains.

In this way a fabric 40 is obtained that is defined by a succession of weft yarn rows interlaced with the chains obtained with the warp yarns; more generally, these weft yarn rows define "fabric rows" 40*a* of the product made by the crochet galloon machine 1*a*.

One example of the structure and operation of a crochet galloon machine can be found in patents EP 0708190, EP 0684331 and EP 1013812.

Should the textile machine 1 be a needle loom 1*b* (FIGS. 4-7), the weaving members 30 can comprise at least one sickle 30*b*, one or more frames 34 each supporting a predetermined number of heddles 33, one needle 30*c*, a compacting reed 30*d* and preferably a knocking-over device 30*e*.

By means of sickle 30*b*, at least one first yarn 62 is transversely interlaced with second yarns 63 supported by the heddles 33, the latter being moved by the heddle frames 34 to define the structure of this interlacing.

The knocking-over device 30*e* guides the first yarn 62 so that the latter engages needle 30*c*, while the compacting reed 30*d* pushes the first yarn 62 towards the already-made fabric portion, thereby ensuring the necessary compactness to the product 40.

It is to be noted that the second yarns 63 are guided by heddles 33 on planes that are substantially parallel to each other (vertical planes relative to the ground), while the first yarn 62 is guided by sickle 30*b* along one or more directions transverse to said planes.

Figure 6:
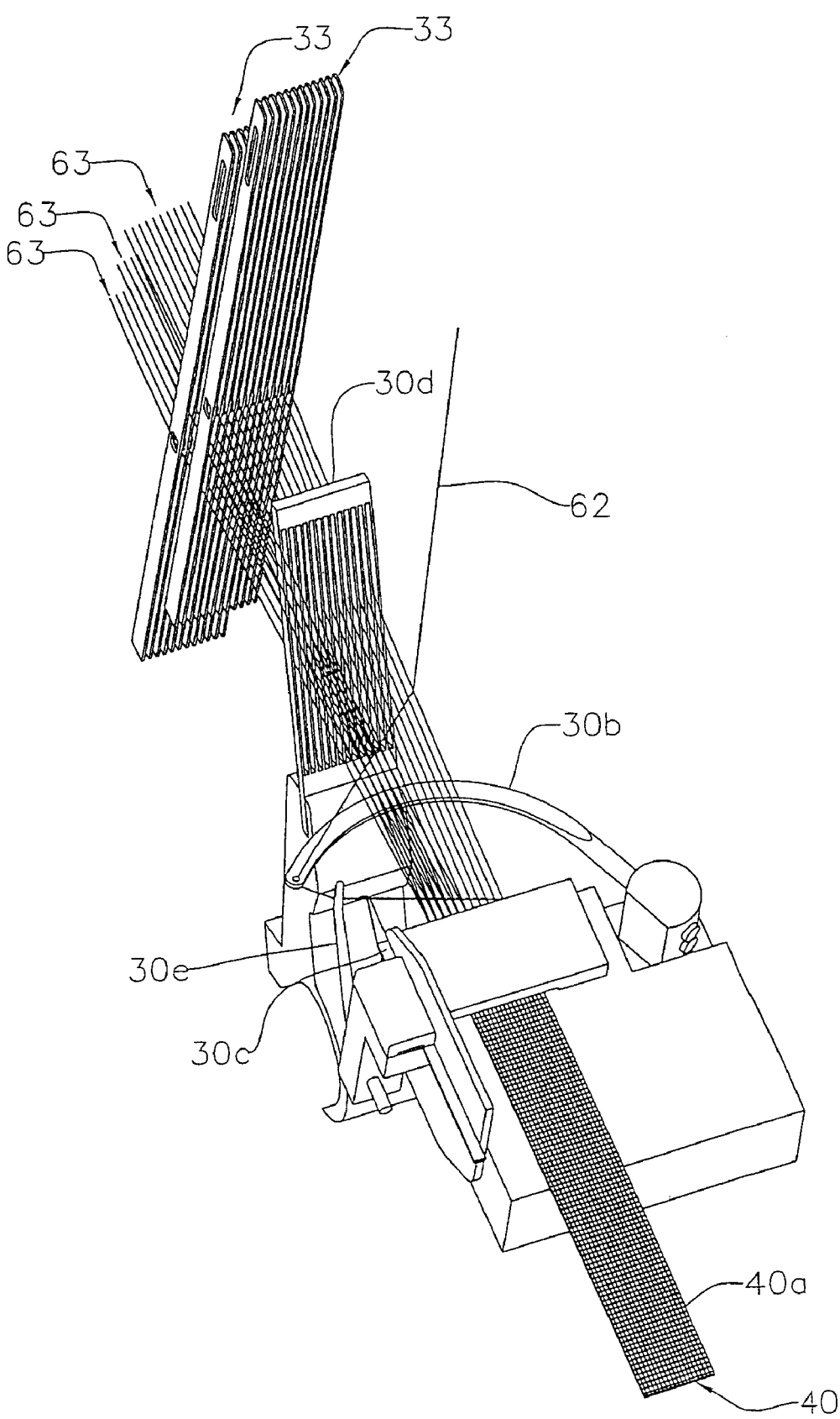
FIGS. 6 and 7 show members of the machine in FIG. 4, with some parts removed for a better view of others, under different operating conditions.

In more detail, in a first operating step of the loom 1*b*, sickle 30*b* takes a first operating position, at which the portion of the first yarn 62 guided by sickle 30*b* is positioned transversely of the second yarns 63, so as to engage said yarns for manufacture of a new fabric row 40*a* (FIG. 6).

Under this condition, the knocking over device 30*e* exerts a downward pressure on the first yarn 62, so that the latter is brought into engagement with a hooked portion provided at one end of needle 30*c*.

In a second operating step, sickle 30*b* is retracted so that its engagement portion is moved away from needle 30*c*; at the same time, the knocking-over device 30*e* moves upwards, thereby enabling needle 30*c* to reach a retracted position, guiding the first yarn 62 until bringing it into contact with the already manufactured fabric portion 40.

Figure 7:
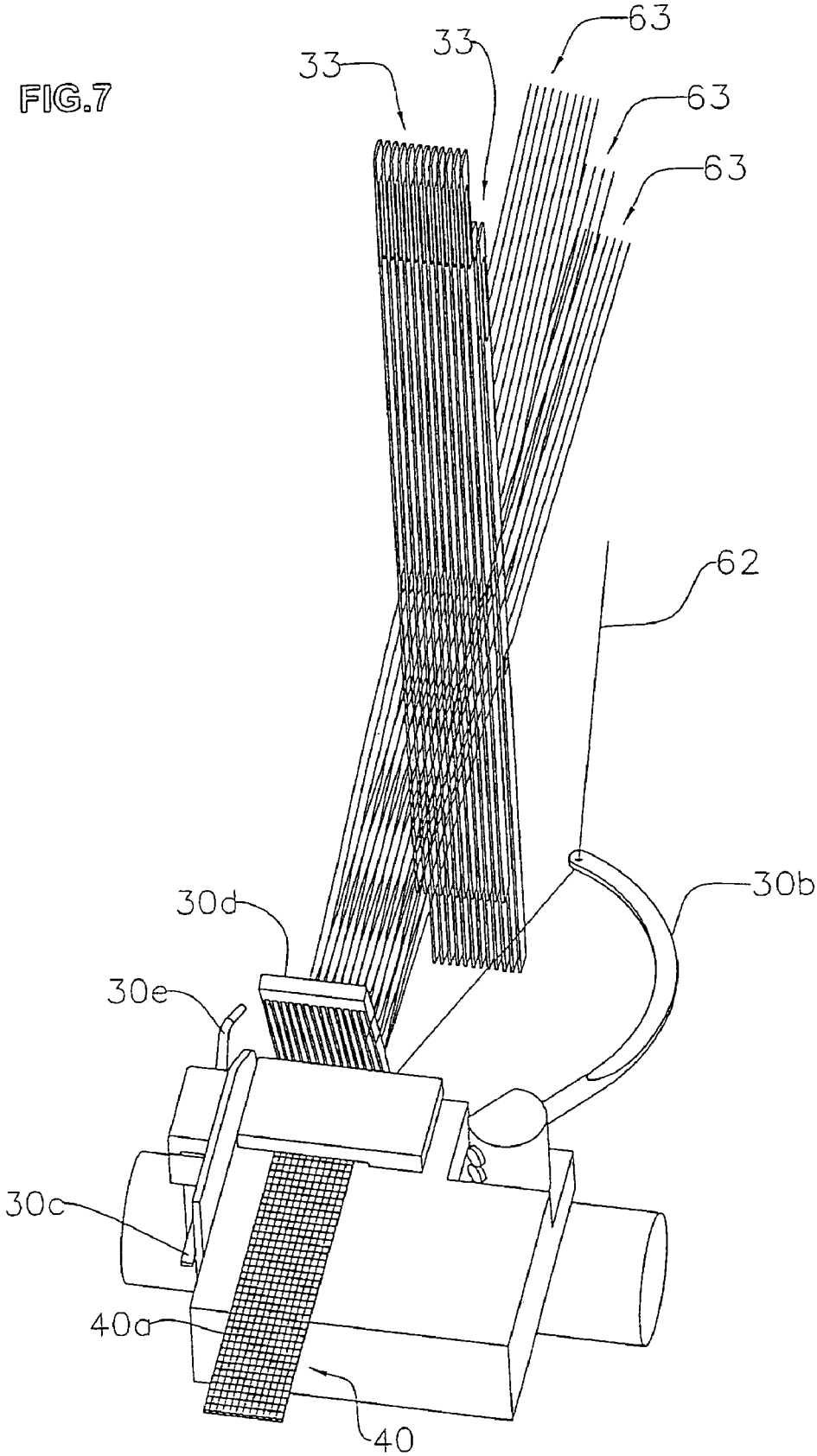

Subsequently, the compacting reed 30*d* moves close to fabric 40, to press the first yarn 62 against the already manufactured fabric portion and fix the new position taken by the first yarn 62 in the fabric (FIG. 7).

Finally, the compacting reed 30*d* moves away from the fabric and heddles 33 are moved according to the preestablished work program, thus starting a new operating cycle of the loom 1*b* to make the subsequent fabric row 40*a*.

Fabric 40 is thus defined by an orderly succession of rows or courses 40*a* (hereinafter referred as "fabric rows") in engagement with said second yarns 63; each fabric row 40*a* is defined by the fabric portion made in one working cycle.

Therefore, each fabric row 40*a* corresponds to accomplishment of the above stated operating steps, carried out in succession.

As can be noticed, in the needle loom 1*b* the second yarns 63 are unwound from beams 50 while the first yarn 62 is unwound from auxiliary members 51 that, being of known type, are not herein further described.

Should the textile machine 1 be a two-bed warp knitting machine 1*c*, the weaving members 30 can comprise a pair of needle bars 30*f*, 30*g*, each supporting a plurality of needles 30*h*; these bars 30*f*, 30*g* have a substantially parallel longitudinal extension and are such disposed that the needles supported by one of them are inclined to the needles supported by the other. It is to be noted that the needles 30*h* mounted on the same bar are substantially parallel to each other.

Each needle bar 30*f*, 30*g* is reciprocated along a direction substantially defined by the longitudinal extension of the needles 30*h* supported by said bar.

In more detail, the two needle bars 30*f*, 30*g* are such oriented that the respective needles 30*h* mutually converge at their ends that are not engaged by the bars.

With reference to the needle bars 30*f*, 30*g*, in the operation cycle of the warp knitting machine 1*c* the following succession of steps is provided:

at the beginning the two needle bars 30*f*, 30*g* are substantially at the same height (i.e. they are in a plane substantially parallel to the ground plane);

subsequently the first bar 30*f* is moved to a higher height, along the direction defined by the longitudinal extension of needles 30*h* supported thereby;

next the first bar 30*f* is brought back to the starting position, at the same height as the second bar 30*g;* afterwards the second bar 30*g* is moved to a higher height than the first one 30*f*, and in particular to the same height to which the first bar 30*f* had been previously moved; this movement takes place along the direction defined by the longitudinal extension of needles 30*h* mounted on the second bar 30*g;* subsequently the second bar 30*g* is brought back to the starting position, and is again to the same height as the first bar 30*f*.

In synchronism with the needle bars 30*f*, 30*g*, a guide bar 35 is also moved; said guide bar 35 through the eye-pointed needles, guides yarns 64 on the extremities of needles 30*h*, so that the yarns 64 themselves can interlace with each other and form the textile product 40.

In more detail, the guide bar 35 has a longitudinal extension substantially parallel to the longitudinal extension of the needle bars 30*f*, 30*g*; the guide bar 35 is moved in such a manner that each eye-pointed needle describes a trajectory stepping over one or more of the respective needles 30*h*, so that yarn 64 is loaded on these needles 30*h* and the textile product 40 is obtained.

In this context, by "fabric row" 40*a* it is intended the fabric portion 40 manufactured in a complete operation cycle, said cycle comprising the above listed steps.

In order to supply said weaving members 30 with the necessary yarns 60, 61, 63, 64 to make fabric 40, the machine 1 is provided with at least one beam 50, on which at least one of said yarns 60, 61, 63, 64 is wound; preferably, the machine 1 comprises a plurality of beams 50, on each of which a respective yarn to be fed to the weaving members 30 is wound.

Associated with said beams 50 is actuating means 70 to rotate the beams 50 to the desired speed, so that the weaving members 30 are fed with the optimal amount of yarn for the working operation to be carried out.

The actuating means 70 can comprise one or more rollers or wheels 70*a* for example, each put into contact with the yarn wound on a corresponding beam 50, so as to move the latter by friction; in more detail, each roller or wheel 70*a* and the respective beam 50 have substantially parallel longitudinal axes.

In addition, said longitudinal axes of each roller or wheel 70*a* and each beam 50 define the respective rotation axes of the rollers and the beams 50 themselves.

The outer surface of the roller or wheel 70*a* is in contact with the radially outermost layer of yarn wound around the beam 50.

To keep the roller or wheel 70*a* in contact with the yarn wound on beam 50, suitable elastic means can be used, such as a spring set to push the roller or wheel 70*a* towards the beam 50; alternatively, a supporting structure 200 can be used along which a support axis of the beam 50 can slide, keeping the beam 50 itself in contact with the roller or wheel 70*a* through exploitation of the beam mass.

In more detail, this supporting structure 200 is provided with an inclined guide 210 adapted to engage one and preferably two axial ends of beam 50, so that the beam 50 itself can freely rotate within this guide 210.

Guide 210 is disposed transversely of the horizontal plane (i.e. the ground plane, on which the machine 1 rests when it is in an operating condition), and keeps the longitudinal axis of beam 50 to a higher height than the longitudinal axis of the roller or wheel 70*a*.

In this way, following a progressive unwinding of the yarn 60, 61, 63, 64 present on the respective beam 50 (i.e. following a reduction in the outer diameter of the yarn wound on the beam), the longitudinal axis of beam 50 decreases its height moving down along guide 210, therefore keeping the yarn to be unwound in contact with the roller or wheel 70*a*.

Alternatively, a structure can be provided in which beam 50 is maintained to a fixed height, while the roller or wheel 70*a* can slide along a sloping (or possibly vertical) guide; in this case too, by exploiting the force of gravity, following progressive unwinding of the yarn present on the beam, the roller or wheel 70*a* slides along the guide and reduces its height, while maintaining its contact with the yarn to be unwound.

A further variant consists in a direct connection between the output shaft of an electric motor (to be better described in the following) and beam 50, without use of auxiliary rollers in contact with the radially outermost layer of the yarn wound on beam 50.

Each beam 50 and the actuating means 70 active on same are mounted on the same supporting structure 200, preferably separated from the base 2 of the machine 1.

The actuating means 70 defines the so-called "unwinding devices" that are actively in contact with beam 50 or the yarn still wound on beam 50 (i.e. before unwinding of the yarn itself) to cause the yarn 60, 61, 63, 64 to be fed to the weaving members 30.

The actuating means operates in such a manner as to reduce tension of the yarn portion already unwound from beam 50 and included between the beam 50 and the weaving members 30 or the feed members 110, should the latter be provided.

It is further to be noticed that the actuating means 70 operates without pulling the yarn 60, 61, 63, 64 to be fed to the weaving members 30.

In fact, the actuating means 70 operates upstream of the yarn section already unwound from beam 50 and "urges" the latter in rotation to enable unwinding of further yarn portions.

In order to adjust the rotation speed of beam 50 (i.e. the feeding speed of the yarn to the weaving members 30), the machine 1 comprises suitable control means 80 connected to said actuating means 70.

Reference for carrying out said control comes from the main shaft 10 of the textile machine 1.

In fact, the machine 1 is provided with a main shaft 10, drivable in rotation, to which are directly or indirectly connected all members and devices being part of the machine 1 itself, so that the same can move in synchronism and operate in a correct manner.

The main shaft 10 rotates around a longitudinal axis thereof at a substantially constant angular speed that is independent of the speed of the other constituent elements of the machine 1; in fact it is a task of said constituent elements to adapt their speed and/or position, depending on the angular position of the main shaft 10.

The main shaft 10 in the accompanying drawings is diagrammatically represented separated from the machine 1, to better show it; actually said main shaft 10 is positioned within the base 2 of the machine 1.

Figure 12:
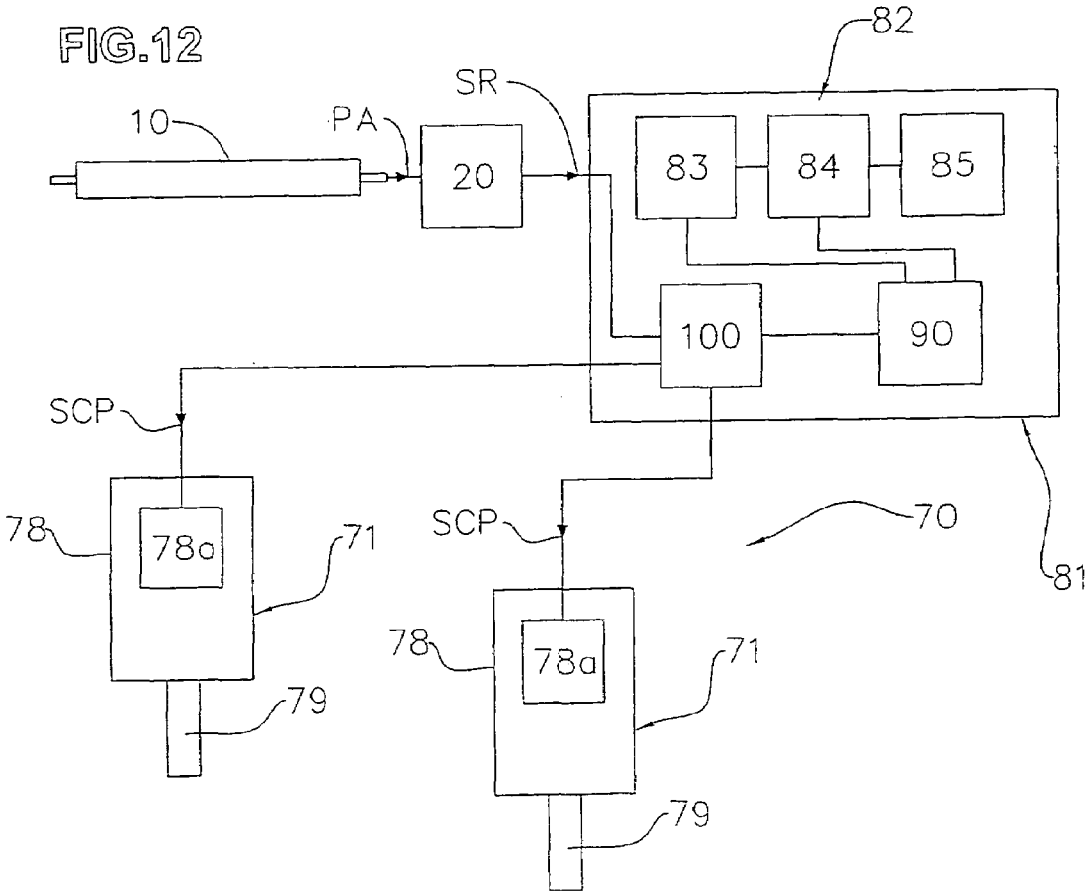
FIG. 12 is a block diagram of a first embodiment of a control system applicable to the machines in FIGS. 1-10.
Figure 13:
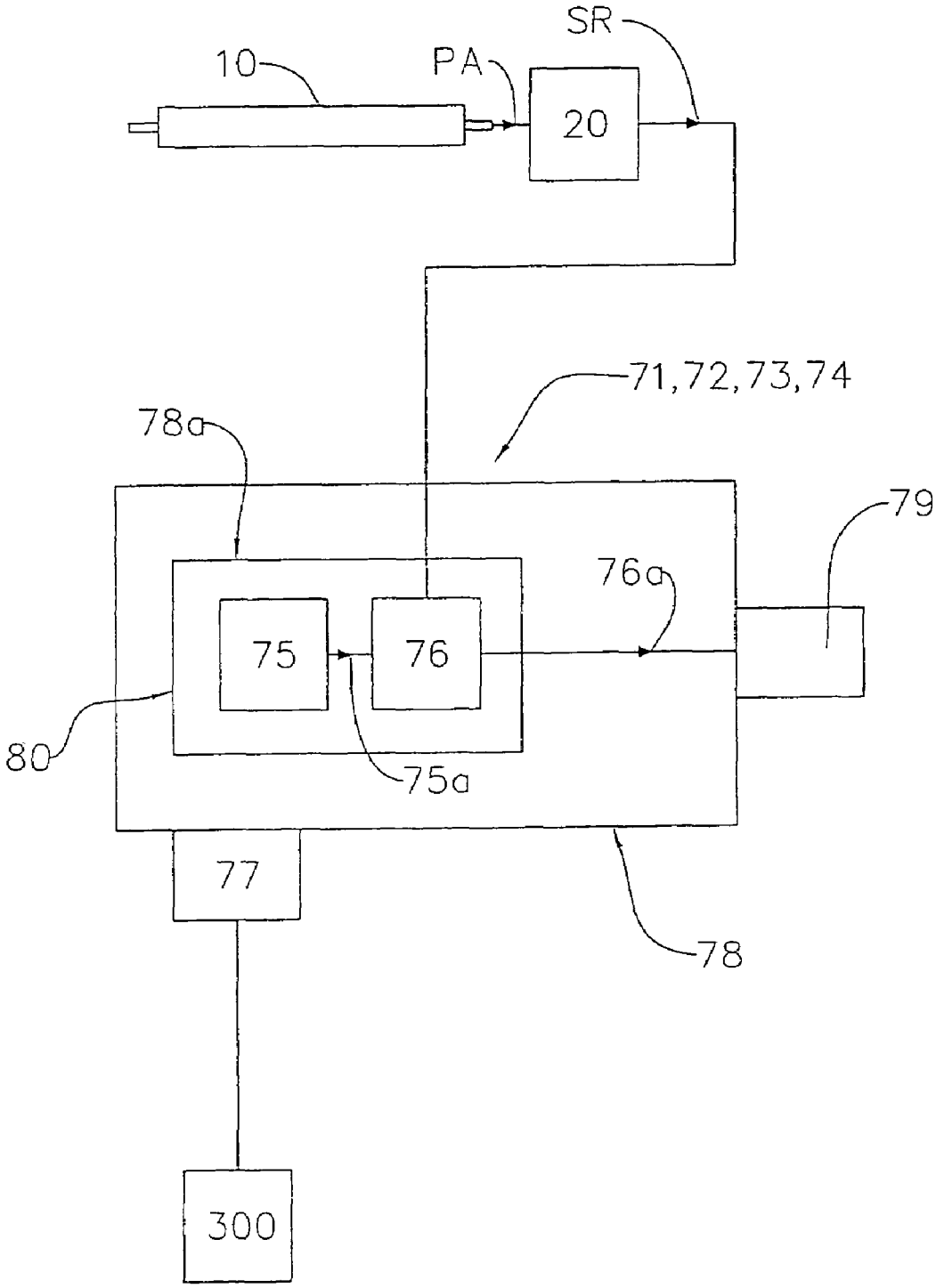
FIG. 13 is a block diagram of the actuators being part of a second embodiment of a control system applicable to the machines in FIGS. 1-10.

Associated with the main shaft 10 is a sensor 20 (FIGS. 12, 13) set to detect at least one angular position PA of the main shaft 10, and to generate a corresponding reference signal SR that is representative of said angular position PA and, by derivation, of the angular speed of the main shaft 10.

Practically, sensor 20 can be an encoder, of the incremental or absolute type.

The reference signal SR is therefore a signal representing the operating position of each member or device of the machine 1; this is in particular valid both where the main shaft 10 is mechanically connected to the different members and devices and where said members and devices are interlocked with the main shaft 10 by means of a structure of the electronic or electromechanical type.

This structure may comprise one or more electric motors for example, that are powered in a controlled manner depending on the angular position PA of the main shaft 10, said angular position being preferably detected by said sensor 20.

The control means 80 therefore receives the reference signal SR from sensor 20 and consequently adjusts the rotation speed of beams 50; in particular the actuating means 70 associated with each beam 50 makes the rotation speed of the latter be adjusted depending on the angular position PA and/or the angular speed of the main shaft 10.

Conveniently, the actuating means 70 comprises a plurality of main actuators 71; each main actuator 71 is connected to a respective beam 50 to set the latter in rotation following modes to be described in the following.

Advantageously, each main actuator 71 consists of an electric motor 78, preferably a brushless motor, or alternatively of a stepping motor, said motor 78 having an output shaft 79 drivable in rotation.

Associated with said motor 78 is an activation block 78*a* for controlled power supply of the motor 78 itself aiming at defining the rotation speed of the output shaft 79.

Figure 11:
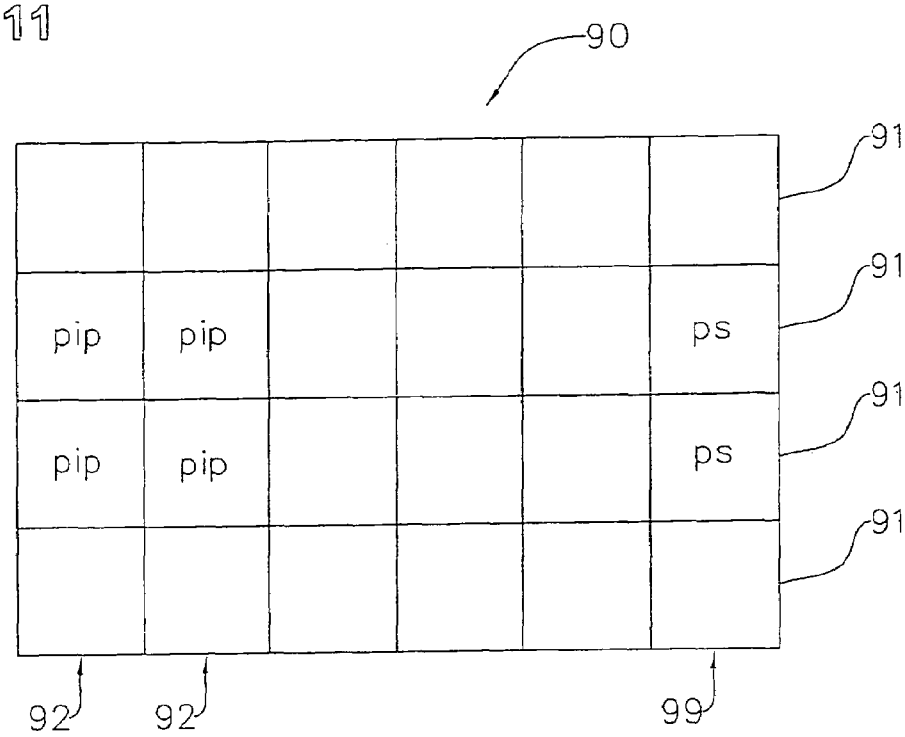
FIG. 11 shows the logic structure of a memory used in a first embodiment of a control system applicable to the machines seen in FIGS. 1-10.

In a first embodiment (FIGS. 11, 12), the control means 80 comprises a control unit 81 connected to each of said main actuators 71 and in particular to said activation block 78*a*; the control unit 81 transmits respective main command signals SCP to the main actuators 71 to move beams 50 depending on the reference signal SR.

The control unit 81 comprises a memory 90, on which one or more main follow-up parameters PIP are stored, each of them being representative of a follow-up action between the output shaft 79 of a respective main actuator 71 and the main shaft 10 of the machine 1.

In particular, the main follow-up parameter PIP represents a follow-up ratio between the output shaft 79 of the main actuator 71 and the main shaft 10, i.e. the ratio between the angular speed of the output shaft 79 and the angular speed of the main shaft 10.

The control unit 81 further comprises comparison means 100, associated with said memory 90, to compare the reference signal SR with the different main follow-up parameters PIP, and generate a corresponding main command signal SCP for each of the main actuators 71.

By virtue of the structure hitherto described, the control unit 81 can send a corresponding main command signal SCP to each of the main actuators 71, to adjust the angular speed of the output shaft 79 of said actuator 71 depending on the angular position PA and therefore the rotation speed of the main shaft 10.

In more detail, the main command signal SCP incorporates all necessary information to specify the movement features of the output shaft 79 of the main actuator 71; this information may comprise the amount of the displacement to be carried out, the time at which displacement must take place, how said displacement can be performed and the gains of the control loops interior to the actuator.

The displacement-performing modes can be the following: electric shaft (simulating a connection through belt or chain between the main shaft and output shaft of the actuator, for example), absolute or incremental cam positioning (simulating an electronic cam of the absolute or incremental type), or pulsed positioning.

Preferably, the control unit 81 transmits said main command signals SCP for each of the fabric rows 40*a* that must be made; in other words, the rotation speed of each beam 50 can be controlled at each fabric row 40*a* of the textile product 40.

In particular, as regards the crochet galloon machine 1*a*, control can be carried out for each weft row; where the needle loom 1*b* and the two-bed warp knitting machine 1*c* are concerned, control can be carried out for each fabric row made in a single working cycle.

Advantageously, control on movement of the unwinding devices 70 of beams 50 can be carried out not only depending on the position of the main shaft 10 of the machine 1, but also depending on displacements that must be performed by the weaving members 30 for manufacture of product 40; the last-mentioned type of control is particularly useful when control on the actuating means 70 is performed at each fabric row 40*a*.

Preferably, movement control of the main actuators 71 depending on the displacements of the weaving members 30 takes place in machines where the weaving members 30 are moved by suitable electromechanical actuators, the latter being interlocked with the control unit 81.

In more detail, memory 90 of the control unit 81 has a plurality of records 91, each of which is associated with a respective fabric row 40*a* and contains operating parameters for manufacture of said fabric row 40*a*.

Each of said records 91 comprises a plurality of main fields 92, each of which contains a respective main follow-up parameter PIP; in other words, in memory 90, for each fabric row 40*a* there is a main follow-up parameter PIP for each main actuator 71.

In this way it is possible to vary the rotation speed of beams 50 without stopping operation of the machine 1; in particular this variation can be carried out for each of the fabric rows 40*a* of the manufactured product 40.

In fact, the control unit 81, depending on the angular position PA of the main shaft 10, selects the record 91 associated with the fabric row 40*a to be made*.

Thus, the main follow-up parameters PIP to be used can be correctly selected, as well as the auxiliary follow-up parameters PIA1, PIA2, and the secondary follow-up parameters PIS to be described in the following.

Therefore, the output shaft 79 of each main actuator 71 rotates with a preestablished synchronism relative to the main shaft 10 of the machine 1, thus giving the weaving members 30 the necessary yarn amount for manufacture of each fabric row 40*a*.

As above mentioned, each main follow-up parameter PIP can be also determined depending on the amplitude of the displacements that the weaving members 30 must perform for obtaining a predetermined fabric row 40*a*. Therefore each main command signal SCP intended for the main actuators 71 can move the latter depending on the displacements of the weaving members 30.

In more detail, the main follow-up parameter PIP (or main command signal SCP) intended for a predetermined main actuator 71 is a function of the displacement of the weaving member 30 receiving the yarn 60, 61, 63, 64 from the beam 50 moved by said predetermined main actuator 71.

To this aim, each record 91 comprises a displacement field 99 containing a displacement parameter PS representing a displacement performed by at least one of said weaving members 30 for manufacture of the fabric row 40*a* associated with such a record 91.

Practically, succession of the values inserted in the displacement fields 99 defines the so-called "numeric chain", representing the displacements of the weaving members 30 during manufacture of the product 40.

Preferably, the main command signal SCP generated in a given fabric row 40*a* for the predetermined main actuator 71 is a function of the displacement that the corresponding weaving member 30 performs at said weft row 40*a*.

For instance, as regards the crochet galloon machine 1*a* (FIGS. 15*a*-15*b*), the main follow-up parameters PIP may comprise first main follow-up parameters PIP1 and second main follow-up parameters PIP2.

The first main follow-up parameters PIP1 are representative of the follow-up action between the main actuators 71 regulating feeding of the weft yarns 60 and the main shaft 10.

Preferably the first main follow-up parameters PIP1 are defined depending on the displacements of the carrier slide bars 31.

In particular, the first main follow-up parameter PIP1 relating to a predetermined main actuator 71 is defined depending on the displacement to be carried out by the carrier slide bar 31 receiving the weft yarn 60 from the beam 50 interlocked with such a predetermined main actuator 71.

The second main follow-up parameters PIP2 are representative of a follow-up action between the main actuators 71 regulating feeding of the warp yarns 61 and the main shaft 10.

Conveniently, the first and/or second main follow-up parameters PIP1, PIP2 are defined for each weft row 40*a* of the product made by the crochet galloon machine 1*a*; thus, for instance, the first main follow-up parameters PIP1 can be used to regulate rotation of the output shafts 79 of the main actuators 71 associated with the beams 50 supporting the weft yarns 60, depending on the displacement performed by the carrier slide bars 31 at each weft row 40*a*.

The control unit 81 can be provided with suitable calculation means 82 to calculate said main follow-up parameters PIP; this calculation advantageously takes place depending on parameters already inputted, such as the displacement parameters PS of the individual weaving members 30 and/or parameters describing the machine structure (e.g. position of needles and threading tubes in the crochet galloon machine 1*a*).

Preferably, said calculation means 82 may comprise a comparator block 83 to compare the main follow-up parameter PIP belonging to a predetermined record 91 with the corresponding main follow-up parameter PIP belonging to the subsequent record (note that in the present context two main follow-up parameters belonging to different records are considered as "corresponding" if they refer to the same main actuator 71; corresponding follow-up parameters are represented as belonging to the same column in memory 90).

Correction means 84 is provided to be associated with the comparator block 83 to vary the main follow-up parameter PIP of the predetermined record 91 depending on said comparison, and possibly the main follow-up parameters PIP belonging to preceding records 91 (note that in the present context by "preceding" record it is intended a record associated with a fabric row 40*a* of prior manufacture in time).

Practically, through the comparator block 83 the difference between two corresponding and consecutive main follow-up parameters PIP is estimated, which means two parameters belonging to adjacent records 91 relating to the same main actuator 71.

If this difference is greater than a predetermined threshold it means that in two subsequent fabric rows 40*a*, amounts of yarn 60, 61, 63, 64 quite different from each other are required; in other words, the corresponding beam 50 is required to vary its angular speed very quickly to supply the correct yarn amount for each fabric row 40*a*.

To prevent yarn 60, 61, 63, 64 from breaking, on occurrence of these quick variations, or the quality of fabric 40 from being adversely affected, the correction means 84 distribute this variation on a greater number of fabric rows 40*a*, so that a variation of an important amount is shared among several fabric rows 40*a*.

By way of example, sharing can be of the linear type: being denoted at "D" the difference between the corresponding main follow-up parameters PIP belonging to the (i)th and the (i+1)th records, being D greater than the previously inputted threshold parameter, a value corresponding to D/3 is calculated (should the difference be shared among three fabric rows 40*a*).

Value D/3 thus obtained is added to the main follow-up parameter PIP of the (i−1)th record; a value corresponding to 2*(D/3) will be added to the main follow-up parameter PIP of the (i)th record, while the follow-up parameter of the (i+1)th record will remain unchanged.

In this way, the preestablished value is in any case reached in the (i+1)th fabric row, but the variation relative to the immediately preceding record is reduced by about ⅓, thereby improving operation and reliability of the feeding system for the yarns used.

In a quite equivalent manner, the starting comparing step can be carried out on displacement parameters relating to the weaving members 30; corrections on the main follow-up parameters PIP are then made following the same technique.

As above mentioned, as regards the crochet galloon machine 1*a*, the first main follow-up parameters PIP1 can be calculated depending on the displacements of the carrier slide bars 31 in each weft row 40*a*.

Each first main follow-up parameter PIP1 can be proportional to a factor defined by the sum of a first and a second parameters PAR1, PAR2.

The first parameter PAR1 is in turn obtained from the sum of a first addend ADD1 and a second addend ADD2.

The first addend ADD1 indicates the difference between the displacement parameter PS(i) belonging to record 91 and the displacement parameter PS(i−1) belonging to the preceding record relative to said record 91; the second addend ADD2 is proportional to the difference between the displacement parameter PS(i) and a parameter PPOS1 or PPOS2 defining the position of the first or second needle 39*a*, 39*b* of the needle bar 30*a*.

The needle bar 30*a* in fact, bears a plurality of needles 39 disposed in side by side relationship and substantially parallel; needles 39 are included between a first needle 39*a* and a second needle 39*b*.

With reference to FIG. 3, the first needle 39*a* is the one disposed most to the right, while the second needle 39*b* is the one disposed most to the left; by way of example it is supposed for the sake of simplicity that the needle bar 30*a* has no needles more to the right than the first needle 39*a* and has no needles more to the left than the second needle 39*b*.

In other words, the first addend ADD1 indicates the displacement amount of the carrier slide bar 31 between the weft row 40*a* associated with record 91 and the preceding one, while the second addend ADD2 indicates the distance between the position taken by the carrier slide bar 31 following displacement as defined by the displacement parameter PS(i) and the position of the first needle 39*a* (with occurrence of a displacement to the right) or the second needle 39*b* (with occurrence of a displacement to the left).

The first addend ADD1 therefore represents the space travelled over by the threading tube during displacement of same from a first weft row 40*a* to the subsequent one; the second addend ADD2 on the contrary indicates the distance separating the final position of the carrier slide bar 31 (defined through the position of a single reference threading tube) from the position of the last needle 39*a*, 39*b*. As above mentioned, said last needle will be the first needle 39*a*, in case of displacement of the bar to the right, or the second needle 39*b* in case of displacement to the left.

It is to be noted that movement of the carrier slide bar 31 beyond the last needle 39*a*, 39*b* physically available on the carrier slide bar 30*a*, allows particular effects to be obtained at the side edges of the textile product 40, exactly due to the presence of excess weft yarn.

The parameters PPOS1, PPOS2 indicating the position of the first and second needles 39*a*, 39*b* are inputted at the beginning of the working operation of the crochet galloon machine 1*a* and they too are stored on a suitable memory register.

The second parameter PAR2 co-operating in defining the first main follow-up parameter PIP1 depends on the speed at which the textile product 40 is drawn by the take-down member 120 (to be described in the following); in fact, the action of the take-down member 120 on the textile product 40 has repercussions, through the textile product 40 itself, on the individual weft yarns 60. Therefore, this factor too is to be taken into account in determining the amount of the weft yarn 60 to be fed to the threading tubes, i.e. in calculating the first main follow-up parameter PIP1.

In the preferred embodiment of the invention, the first follow-up parameter PIP1 is obtained from the following relations:

$$PIP1=(PAR1+PAR2)*KI1$$

$$PAR1=ADD1+ADD2$$

$$ADD1=PS(i)-PS(i-1)$$

$$ADD2=PS(i)-PPOS1$$

$$(\text{or } ADD2=PS(i)-PPOS2)$$

wherein:

PIP1 is the first main follow-up parameter;

PAR1 is the first parameter, equal to ADD1+ADD2;

PAR2 is the second parameter;

KI1 is a previously-stored proportionality constant.

The first main follow-up parameter PIP1 calculated as above stated can take values included between 0 and 30000, both in case of use of brushless motors and in case of stepping motors; however, for a correct and reliable operation of the machine 1*a*, it is suitable that too sudden variations should not be caused in changing the rotation speed of the output shaft 79 of each main actuator 71.

Therefore, the comparing block 83 calculates the difference between the first main follow-up parameter PIP1 of each record 91 and the first follow-up parameter of the next record and compares it with a previously stored threshold, that can be conveniently set to 10000.

Should the difference exceed the previously stored threshold, correction means 84 carries out variation of the first main follow-up parameter PIP1, together with a predetermined number of preceding first follow-up parameters (i.e. belonging to records associated with weft rows that must be made beforehand) so as to make said variation between consecutive first follow-up parameters less sudden.

In more detail the correction means selects a predetermined number of first follow-up parameters (three, for example), and linearly shares said detected difference among them, so that the variation that appeared to be too sudden is shared among several weft rows.

It may be considered, by way of example, a difference between a predetermined main follow-up parameter PIP1 and the subsequent one that is equal to 27000; since a variation of such an amount between a weft row and the subsequent one cannot be ordered to the main actuator, two intermediate values (9000 and 18000) are calculated (the first being obtained through division of 2700 by 3, and the second being obtained through multiplication of the first by 2) that are added to the predetermined first main follow-up parameter PIP1 and the first main follow-up parameter associated with the preceding record.

In this way, between each weft row and the subsequent one, the difference between the respective first main follow-up parameters PIP1 always keeps smaller than the established threshold (equal to 10000), and the maximum value is gradually reached in the space of three weft rows.

Obviously, also different connecting techniques based on more complicated mathematical functions (e.g. generic splines) can be alternatively used to obtain gradual variations in case of first main follow-up parameters very different from each other.

The calculation means 82 can also be provided with a modification block 85 which can carry out a further correction of the first main follow-up parameter PIP1 preferably calculated as above described; this correction is carried out taking into account the elasticity of the weft yarn 60.

In particular, the modification is performed following the relation:

$$PIP1' = PIP1*(1-\text{elast}\,\%/200)$$

wherein PIP1' is the first main follow-up parameter after correction, PIP1 is the first follow-up parameter before correction, elast % is the percent elasticity of the considered weft yarn 60.

The above correction obviously will not be of importance, should the elasticity of the weft yarn 60 be negligible.

As regards the second main follow-up parameters PIP2, i.e. those relating to beams 50 supplying the warp yarns 62, calculation can be carried out depending on the rotation speed of the take-down member 120 (to be described in detail in the following).

In more detail, each second main follow-up parameter PIP2 can be a function of a first parameter P1 and a second parameter P2.

The first parameter P1 is representative of the amount of warp yarn 61 that is "requested" following the action of the take-down member 120; this member in fact by picking up the textile product 40 from the front grooved bar and supplying it to the exit, concurrently causes a drawing action carried out on the warp yarns 61 that are still to be interlaced with the weft yarns 60 for obtaining new portions of the textile product.

The effect caused by this drawing action is therefore kept into account, through said first parameter P1, in estimating the amount of warp yarn 61 to be supplied to the eye-pointed needles.

In particular, the value of the first parameter P1 is expressed as the amount of warp yarn drawn by the take-down member 120 for each revolution of the output shaft of the actuator associated with the take-down member 120 itself.

The second parameter P2 indicates the amount of warp yarn that is supplied to the guide bar 32 at a rotation of 360° of the main shaft 10, when the follow-up ratio between the output shaft of the actuator regulating unwinding of the warp yarn, and the main shaft 12 is unitary.

In the preferred embodiment of the invention, the second main follow-up parameter PIP2 is a function of the ratio between the first and second parameters P1, P2 and, more particularly, is obtained by the relation:

$$PIP2 = KI2*[(P1/P2)+k_\text{needles}]$$

wherein

PIP2 is the second follow-up parameter;

P1 is the first parameter;

P2 is the second parameter;

k_needles represents the amount of warp yarn drawn by each needle during movement of same away from the guide bar 32;

KI2 is a prestored proportionality constant.

The coefficient k_needles is proportional to the ratio between the stroke of the needles (in a displacement parallel to the longitudinal needle extension) and the amount of yarn supplied to the guide bar 32 for each full rotation (of 360°) of the output shaft of the actuator regulating unwinding of the warp yarn.

Where the needle loom 1*b* is concerned, as regards the main follow-up parameters PIP relating to the beams 50 feeding the second yarns 63, these parameters can be calculated depending on the displacements that the heddles 33, through frames 34, must carry out to obtain each product row 40*a*.

In fact, the amplitude of said displacements is varied during production of the fabric 40, so as to give the latter particular geometries or aesthetic effects, and through adjustment of the unwinding operation of the respective beams 50 it is possible to supply the heddles 33 themselves with the necessary yarn amount.

Preferably, at least the main follow-up parameters PIP relating to the beams 50 feeding the second yarns 63 can be a function also of the rotation speed of the take-down member 120 (to be better described in the following).

It is to be noticed that, as regards the needle loom 1*b* as well, the main follow-up parameters PIP are provided to be corrected both when an excessive difference between the corresponding main follow-up parameters PIP belonging to adjacent records 91 is detected and when the elasticity of the yarn therein used is required to be taken into consideration.

Where the two-bed warp knitting machine 1*c* is concerned, the main follow-up parameters PIP relating to the beams 50 feeding yarns 64 can be calculated depending on the movements to which the guide bar 35 is submitted for making each fabric row 40*a*.

In calculating the main follow-up parameters PIP of the two-bed warp knitting machine 1*c* it is also possible to take into account the rotation speed of the take-down member 120.

Also as regards the two-bed warp knitting machine 1*c*, the main follow-up parameters PIP are provided to be corrected both when an excessive difference between the corresponding main follow-up parameters PIP belonging to adjacent records 91 is detected and when the elasticity of the yarns used is required to be taken into account.

It is to be noticed that the main follow-up parameters PIP can be directly entered on memory 90 of the control unit 81 after being calculated and suitably "amended" following the above stated techniques.

Alternatively, the control unit 81 can be provided with said calculation means 82 that, based on the data entered by the operator and relating to the features of the machine and the displacements that the different weaving members must perform, does the necessary to determine the correct follow-up parameters by which movement of beams 50 is to be controlled, in an automatic manner.

In a second embodiment, control on rotation of the output shafts 79 of the main actuators 71 can be carried out in a distributed manner.

In fact, each actuator 71 can be locally provided with a memory 75 and related comparator means 76 (FIG. 13) both preferably incorporated into said activation block 78*a*; memory 75 comprises at least one follow-up parameter 75*a* that is representative of a follow-up action between the output shaft 79 of this main actuator 71 and the main shaft 10 of the machine 1.

In this case too, preferably, the follow-up parameter 75*a* is a follow-up ratio between the main actuator 71 and main shaft 10, and in particular a ratio between the angular speed of the output shaft 79 of said actuator 71 and the angular speed of the main shaft 10.

The comparison means 76 is connected both to sensor 20, and memory 75 to compare the reference signal SR with the follow-up parameter 75*a*; in this way a command signal 76*a* is generated for relative adjustment of the rotation speed of the output shaft 79 of said actuator 71.

The memory 75 of each activation block 78*a* may possibly contain a plurality of follow-up parameters 75*a*, so that the follow-up ratio (or, more generally, the follow-up relation) between the output shaft 79 of actuator 71 and the main shaft 10 can be varied during operation of the machine 1 without stopping the machine operation.

In more detail, it is provided that a follow-up parameter 75*a* for each of the fabric rows 40*a* to be made should be stored in said memory 75, so that the follow-up operation can be varied at each of said rows 40*a*.

Generally, therefore in this second embodiment the control means 80 comprises the different activation blocks 78*a* of the main actuators 71.

The textile machine 1 can be further provided with picking-up means 110, 120 to draw the yarn unwound from beam 50 and make the yarn itself reach the weaving members 30.

Where a crochet galloon machine 1*a* and a two-bed warp knitting machine 1*c* are concerned, the picking up means may comprise one or more feed members 110 to be better described in the following.

Where the needle loom 1*b* is concerned, the picking up means may comprise a take-down member 120; this case too will be better described in the following.

As mentioned above, advantageously, preferably where the crochet galloon machine 1*a* and two-bed warp knitting machine 1*c* are concerned, the picking up means may comprise one or more feeding members 110; each feeding member 110 is interposed between one or more beams 50 and the weaving members 30, so as to further adjust tension of the yarn fed to the weaving members 30 themselves.

Practically, each feeding member 110 is associated with a respective weaving member 30 to supply the latter with the necessary yarns 60, 61, 64.

Each feeding member 110 is active on a respective yarn 60, 61, 64 and in particular on a portion of the yarn itself that has already been unwound from beam 50, to carry out such a regulation, unlike said actuating means 70 that directly acts either on beam 50 or on the yarn still wound thereon.

In the accompanying figures the feeding members 110 are shown mounted on base 2 of the machine 1; however, alternatively, these members can be mounted on structures separated from base 2 and positioned to a suitable distance from the machine 1.

Each feeding member 110 can consist of at least two rollers 11, 112 the outer surfaces of which are in contact with each other; the yarn 60, 61, 64 from beam 50 is caused to pass between the two rollers 111, 112 and through adjustment of the rotation speed of said rollers, tension and amount of the yarn supplied to the weaving members 30 is correspondingly regulated. Conveniently, as shown in FIG. 14*a*, each feeding member 110 is further provided with a third roller 113.

In more detail, the first roller 111 has a first bearing arc 111*a* for yarn 60, 61, 64 coming from beam 50, said first bearing arc 111*a* being delimited by a first and a second ends 11*b*, 111*c*. The second roller 112 has a second bearing arc 112*a* delimited by a first and a second ends 112*a*, 112*b*; the third roller 113 has a third bearing arc 113*a* having at least one first end 113*b*.

Conveniently, the first, second and third rollers 11, 112, 113 are disposed close to each other in such a manner that the second end 111*c* of the first bearing arc 111*a* is coincident with the first end 112*b* of the second bearing arc 112*a*, and the second end 112*c* of the second bearing arc 112*a* is coincident with the first end 113*b* of the third bearing arc 113*a*.

In this way, an optimal engagement between the feeding member 110 and the yarns 60, 61, 64 to be fed to the weaving members 30 is obtained.

Each feeding member 110 is preferably associated with a respective secondary actuator 72 for setting said rollers 111, 112, 113 in rotation with predetermined angular speeds.

Each secondary actuator 72 comprises an electric motor 78, preferably a brushless motor, or alternatively a stepping motor, provided with an output shaft 79 drivable in rotation.

This motor 78 is associated with an activation block 78*a* adjusting powering of same thereby defining the rotation speed of the output shaft 79.

The output shaft 79 of each secondary actuator 72 is operatively active on the first roller 111, and preferably on the third roller 113 of the corresponding feeding member 110, the second roller 112 being idly mounted on its rotation axis and moved by friction by the two other rollers.

As above mentioned with reference to control of the unwinding members of beams 50, also for movement adjustment of the feeding members 110 two possibilities are offered.

According to the first embodiment, the control unit 81 is connected to each secondary actuator 72 and in particular to the activation block 78*a*, to send thereto a respective secondary command signal SCS generated depending on the reference signal SR transmitted from sensor 20.

To this aim, memory 90 of the control unit 81 may comprise a predetermined number of secondary follow-up parameters PIS (FIGS. 15*a*, 15*b*; 17*a*, 17*b*); the comparator means 110 carries out a comparison between the reference signal SR and these secondary follow-up parameters PIS and sends the respective secondary command signal SCS to each secondary actuator 72.

Each secondary follow-up parameter PIS is representative of a follow-up action between the output shaft 79 of the secondary actuator 72 and the main shaft 10 of the machine 1.

Preferably, the secondary follow-up parameter PIS is a follow-up ratio representing the ratio between the angular speed of the output shaft 79 of the secondary actuator 72 and the angular speed of the main shaft 10.

Consequently, following comparison between the reference signal SR and the contents of memory 90, rotation of the output shaft 79 of each secondary actuator 72 can be adjusted depending on the angular position PA, and therefore the angular speed, of the mains shaft 10.

Preferably, the control unit 81 is arranged to send a secondary command signal SCS to each secondary actuator 72 for each fabric row 40*a* to be made.

To this aim, each record 91 of memory 90 comprises one or more secondary fields 93, each associated with a respective secondary actuator 72; each secondary field 93 contains one of said secondary follow-up parameters PIS.

The comparison means 100 of the control unit 81 therefore carries out comparison between the reference signal SR and each secondary follow-up parameter PIS and generates a corresponding secondary command signal SCS for each of the secondary actuators 72.

In this way, the command signal SCS sent to the activation block 78*a* of the secondary actuator 72 allows the angular speed of the output shaft 79 of said secondary actuator 72 to be regulated and the tension and amount of the yarn fed to the weaving members 30 to be defined.

Preferably, the secondary follow-up parameters PIS are defined depending on the displacements that the weaving members 30 must carry out; in particular, the secondary follow-up parameter PIS relating to a predetermined feeding member 110 can be a function of the displacement to be carried out by the weaving member 30 receiving the yarn from said predetermined feeding member 110.

It is to be noted that the above illustrated functional relations for definition of the main follow-up parameters PIP can be also used for definition of the secondary follow-up parameters PIS.

Likewise, the above described correction techniques (based on too high differences between corresponding and adjacent follow-up parameters) can be applied to the secondary follow-up parameters PIS.

In addition, the secondary follow-up parameters PIS too can be directly calculated by the control unit 81 and are preferably provided for each fabric row 40*a*.

In the second embodiment of the invention, the activation block 78*a* of each secondary actuator 72 is provided with a memory 75 containing one or more follow-up parameters 75*a*, each representing a follow-up action between the output shaft 79 of actuator 72 and the main shaft 10 of the machine 1.

In more detail, the follow-up parameter 75*a* is a follow-up parameter identifying the ratio between the angular speed of the output shaft 79 and the angular speed of the main shaft 10.

The activation block 78*a* of each secondary actuator 72 further comprises comparison means 76 connected to said memory 75 and sensor 20; the comparison means 76 carries out a comparison between the reference signal SR transmitted from sensor 20 and the follow-up parameter 75*a* stored in memory 75.

Depending on this comparison, the secondary actuator 72 sets its output shaft 79 in rotation so that it has the required angular speed.

In addition to the above, the memory 75 of each secondary actuator 72 is provided to hold a plurality of follow-up parameters 75*a* to enable the rotation speed of the output shaft 79 of such an actuator 72 to be varied without stopping operation of the machine 1.

Each of these follow-up parameters 75*a* can be associated with a respective fabric row 40*a* of the product 40 to be made, so that for each of the fabric rows 40*a* the rotation speed of the output shaft 79 of each secondary actuator 72 can be defined in a specific manner.

In the second embodiment, the control means 80 also comprises the activation blocks 78*a* of the secondary actuators 72.

Where the crochet gallon machine 1*a* is concerned, both a feeding member 110 interposed between the beams 50 and the carrier slide bars 31 to adjust tension and speed of the weft yarns 60, and a feeding member 110 interposed between the beams 50 and the guide bars 32 to adjust tension and speed of the warp yarns 61 can be provided.

Where the two-bed warp knitting machine 1*c* is concerned, the feeding members are preferably interposed between the beam (or beams) 50 and the guide bar 35, to adjust the speed and tension of the yarns 64 supplied to said guide bar.

Advantageously, in all cases, i.e. as regards the crochet galloon machine 1*a*, needle loom 1*b* and two-bed warp knitting machine 1*c*, as above mentioned the textile machine 1 may further comprise at least one take-down member 120 to draw the finished product 40 out of the weaving members 30; the take-down member 120 is therefore interposed between the weaving members 30 and a collecting device 130 for the finished product 40 (should said collecting device 130 be present).

In the needle loom 1*b*, the take-down member 120 defines said picking-up means; vice versa, in the crochet galloon machine 1*a*, said picking-up means is defined by the feeding members 110, the take-down member 120 being entrusted with the task of imposing the correct tension to yarns 60, 61 at the weaving members 30.

However, in a needle loom 1*b* as well, a quite similar feeding member can be used which is interposed between the weaving members 30 and beams 50 to adjust feeding of the second yarn 63 to the weaving members 30 themselves; in this case this feeding member defines said picking-up members.

The take-down member 120 has a structure very similar to that of said feeding members 110; in fact, it can consist of at least two rollers 121, 122 between which the product 40 is caused to pass to enable supply of same to the exit of the machine 1.

The first and second rollers 121, 122 have outer radial surfaces in mutual-contact relationship; at least the first roller 121 is driven in rotation around a longitudinal axis thereof, by a first auxiliary actuator 73, the second roller 122 being set in rotation by friction.

Conveniently, as shown in FIG. 14*b*, the take-down member 120 may also comprise a third roller 123 associated with the first and second rollers 121, 122 to better guide the finished product 40 and define the take-down tension of same in a precise manner.

In more detail, the first roller 121 has a first bearing arc 121*a* for the textile product 40, said first bearing arc 121*a* being delimited by a first and a second ends 121*b*, 121*c*. The second roller 122 has a second bearing arc 122*a* delimited by a first and a second ends 122*b*, 122*c*; the third roller 123 has a third bearing arc 123*a* having at least one first end 123*b*.

Conveniently, the first, second and third rollers 121, 122, 123 are disposed close to each other in such a manner that the second end 121*c* of the first bearing arc 121*a* is coincident with the first end 122*b* of the second bearing arc 122*a*, and the second end 122*c* of the second bearing arc 122*a* is coincident with the first end 123*b* of the third bearing arc 123*a*. In this manner, an optimal engagement between the take-down member 120 and the product 40 to be supplied to the exit of the machine 1 can be obtained.

It is to be noted that, both in FIG. 14*a* and in FIG. 14*b*, concerning the feeding members 110 and take-down member 120 respectively, the proportions between the diameters of the different rollers are given diagrammatically and by way of example only.

In addition, in the needle loom 1*b*, in place of a single third roller 123 use may be provided for two or more separated rollers (as diagrammatically shown in FIG. 4), each of them being set to co-operate with the first and second rollers 121, 122 for drawing of a respective finished product.

For movement of the take-down member 120, the machine 1 is provided with a first auxiliary actuator 73 comprising an electric motor 78, preferably a brushless motor or, alternatively, a stepping motor; this motor has an output shaft 79 drivable in rotation for movement of the take-down member 120.

Associated with said motor 78 is an activation block 78*a* for controlled powering of motor 78 and consequent definition of the rotation speed of the output shaft 79.

The output shaft 79 of the first auxiliary actuator 73 is connected to the first roller 121 and preferably to the third roller 123 of the take-down member 120, while the second roller 122 is idly mounted on a rotation axis thereof and is moved by friction by the two other rollers.

The angular speed of the output shaft 79 of the first auxiliary actuator 73 can be adjusted depending on the angular position PA, i.e. the rotation speed, of the main shaft 10 of the machine 1. This adjustment can be carried out following different control structures in the first and second embodiments of the invention.

In the first embodiment, the control unit 81 is also connected to the first auxiliary actuator 73 and in particular to the activation block 78*a*, to send one or more auxiliary command signals SCA1 to the latter depending on the angular position PA of the main shaft 10 incorporated into said reference signal SR.

To this aim, memory 90 of the control unit 81 may comprise a predetermined number of first auxiliary follow-up parameters PIA1 (FIGS. 15*a*, 15*b*; 16*a*, 16*b*); the comparison means 100 carries out a comparison between the reference signal SR and said auxiliary follow-up parameters PIA1, and sends the respective command signal SCAL to the first auxiliary actuator 73.

Each of said first auxiliary follow-up parameters PIA1 is representative of a follow-up action between the output shaft 79 of the first auxiliary actuator 73 and the main shaft 10 of the machine 1.

Preferably, each first auxiliary follow-up parameter PIA1 is a follow-up ratio representing the ratio between the angular speed of the output shaft 79 of the first auxiliary actuator 73 and the angular speed of the main shaft 10.

Consequently, following comparison between the reference signal SR and contents of memory 90, rotation of the output shaft 79 of the first auxiliary actuator 73 can be regulated depending on the angular position PA and therefore the angular speed, of the main shaft 10.

Due to the fact that in memory 90 several first auxiliary follow-up parameters PIA1 can be present, the follow-up action between the output shaft 79 of the first auxiliary actuator 73 and the main shaft 10 during operation of the machine can be varied without stopping manufacture of the product 40.

Preferably, the control unit 81 is designed to send a first auxiliary command signal SCA1 to the first auxiliary actuator 73 for each fabric row 40*a* to be made.

To this aim, each record 91 of memory 90 comprises a first auxiliary field 94 associated with the first auxiliary actuator 73; each first auxiliary field 94 contains one of said first auxiliary follow-up parameters PIA1.

The comparison means 100 of the control unit 81 therefore carries out comparison between the reference signal SR and each first auxiliary follow-up parameter PIA1, and generates a corresponding first auxiliary command signal SCA1 for the first auxiliary actuator 73, for each fabric row 40*a* to be made.

In this way, the first auxiliary command signal SCA1 sent to the activation block 78*a* of the first auxiliary actuator 73 allows the angular speed of the output shaft 79 of such an actuator 73 to be adjusted, while correspondingly defining the speed and tension for drawing the finished product 40 out of the machine 1.

In the second embodiment of the invention, the activation block 78*a* of the first auxiliary actuator 73 is provided with a memory 75 containing one or more follow-up parameters 75*a*, each of which represents a follow-up action between the output shaft 79 of actuator 73 and the main shaft 10 of the machine 1.

In more detail, the follow-up parameter 75*a* is a follow-up ratio identifying the ratio between the angular speed of the output shaft 79 and angular speed of the main shaft 10.

The activation block 78*a* of the first auxiliary actuator 73 further comprises comparison means 76 connected to said memory 75 and sensor 20; the comparison means 76 carries out comparison between the reference signal SR transmitted from sensor 20 and the follow-up parameter 75*a* stored in memory 75. Depending on this comparison, the first auxiliary actuator 73 drives its output shaft 79 in rotation so that it has the required angular speed.

In addition to the above, memory 75 of the first auxiliary actuator 73 is provided to contain a plurality of follow-up parameters 75*a* to enable the rotation speed of the output shaft 79 of this actuator 73 to be varied without stopping operation of the machine 1. Each of these follow-up parameters 75*a* can be associated with a respective fabric row 40*a* of the product 40 to be made, so that for each of the fabric rows 40*a* the rotation speed of the output shaft 79 of said first auxiliary actuator 73 can be defined in a specific manner.

In the second embodiment therefore, the control means 80 also comprises the activation block 78*a* of the first auxiliary actuator 73.

Conveniently, preferably where the two-bed warp knitting machine 1*c* is concerned, the textile machine 1 may further comprise a collecting device 130 to collect the finished product 40 fed from the weaving members 30 and possibly drawn by the take-down member 120.

At all events, a quite similar collecting device can be also used in the other types of the machine 1.

The collecting device comprises at least one main roller 131 around which the textile product 40 already made is wound up; this roller 131 is driven in rotation around a longitudinal axis thereof by a second auxiliary actuator 74 that can be connected to roller 131 through a suitable kinematic mechanism.

In order to optimise the step of collecting the textile product 40 and keep the product quality unchanged after winding around roller 131, operation of the collecting device 130 can be regulated depending on the angular position PA of the main shaft 10 of the machine 1. In particular, the rotation speed of the collecting roller 131 can be adjusted depending on the angular position PA, and therefore the angular speed, of the main shaft 10.

To this aim, the textile machine 1 comprises said second auxiliary actuator 74 connected to the collecting device 130. The second auxiliary actuator 74 is provided with an electric motor 78, preferably a brushless motor or, alternatively, a stepping motor, having an output shaft 79 drivable in rotation and active on the collecting device 30.

Associated with this motor 78 is an activation block 78*a* for controlled powering of same aiming at defining the rotation speed of the output shaft 79.

In the first embodiment of the textile machine 1, the control unit 81 is also connected to the second auxiliary actuator 74 and in particular to the activation block 78*a* to send one or more second auxiliary command signals SCA2 to said activation block, depending on the angular position PA of the main shaft 10 incorporated in said reference signal SR.

To this aim, memory 90 of the control unit 81 may comprise a predetermined number of second auxiliary follow-up parameters PIA2 (FIGS. 17*a*, 17*b*); the comparison means 100 carries out a comparison between the reference signal SR and said second auxiliary follow-up parameters PIA2 and sends the second auxiliary actuator 74 the respective command signal SCAL.

Each of said second auxiliary follow-up parameters PIS2 represents a follow-up action between the output shaft 79 of the second auxiliary actuator 74 and the main shaft 10 of the machine 1.

Preferably, each second auxiliary follow-up parameter PIA2 is a follow-up ratio representative of the ratio between the angular speed of the output shaft 79 of the second auxiliary actuator 74 and the angular speed of the main shaft 10.

Consequently, following comparison between the reference signal SR and contents of memory 90, rotation of the output shaft 79 of the second auxiliary actuator 74 can be adjusted depending on the angular position PA, and therefore the angular speed, of the main shaft 10.

Due to the fact that several auxiliary follow-up parameters PIA2 are present in memory 90, the follow-up action between the output shaft 79 of the second auxiliary actuator 74 and the main shaft 10 can be varied during operation of the machine without stopping manufacture of the product 40.

Preferably, the control unit 81 is set to send a second auxiliary command signal SCA2 to the second auxiliary actuator 74 for each fabric row 40 to be made.

To this aim, each record 91 of memory 90 comprises a second auxiliary field 95 associated with the second auxiliary actuator 74; each second auxiliary field 95 contains one of said second auxiliary follow-up parameters PIA2.

The comparison means 100 of the control unit 81 therefore carries out a comparison between the reference signal SR and each second auxiliary follow-up parameter PIA2 and generates a corresponding second auxiliary command signal SCA2 for the second auxiliary actuator 74, for each fabric row 40*a* to be made.

In this way, the second auxiliary command signal SCA2 sent to the activation block 78*a* of the second auxiliary actuator 74 allows the angular speed of the output shaft 79 of this actuator 74 to be adjusted, while correspondingly defining the speed and tension for collection of the finished product 40 by the collecting device 130.

In the second embodiment of the invention, the activation block 78*a* of the second auxiliary actuator 74 is provided with a memory 75 containing one or more follow-up parameters 75*a* each being representative of a follow-up action between the output shaft 79 of actuator 74 and the main shaft 10 of the machine 1.

In more detail, the follow-up parameter 75*a* is a follow-up ratio identifying the ratio between the angular speed of the output shaft 79 and angular speed of the main shaft 10.

The activation block 78*a* of the second auxiliary actuator 74 further comprises comparison means 76 connected to said memory 75 and sensor 20; the comparison means 76 carries out a comparison between the reference signal SR transmitted from sensor 20 and the follow-up parameter 75*a* stored in memory 75. Depending on this comparison, the second auxiliary actuator 74 drives its output shaft 79 in rotation so that it has the required angular speed.

In addition to the above, the memory 75 of the second auxiliary actuator 74 is provided to contain a plurality of follow-up parameters 75*a* to enable the rotation speed of the output shaft 79 of actuator 74 to be varied without stopping operation of the machine 1.

Each of said follow-up parameters can be associated with a respective fabric row 40*a* of the product 40 to be made, so that for each of the fabric rows 40*a* the rotation speed of the output shaft 79 of said second auxiliary actuator 74 can be defined in a specific manner.

In the second embodiment therefore the control means 80 can further comprise the activation block 78*a* of the second auxiliary actuator 74.

At the light of the above, it is apparent that in the first embodiment the control means 80 of the textile machine 1 is provided with a single control unit 81 managing operation of said actuators in a centralised manner.

The control unit 81 can be made as an electronic computer such as a controller supervising operation of the machine 1 and preferably managing both rotation of beams 50 and movement of the weaving members 30.

In the second embodiment the control means 80 comprises the different activation blocks 78*a* for actuators 71, 72, 73, 74 so that each actuator manages the member or device with which it is associated in an independent manner, depending on the angular position and/or rotation speed of the main shaft 10; preferably each of said actuators is provided with a housing body in which both the electric motor 78 and the activation block 78*a* of such an actuator are positioned.

It is to be noted that, in the second embodiment of the invention, i.e. where use of a centralised control unit 81 is not provided but each actuator is directly connected with sensor 20 to receive the reference signal SR and control the rotation speed of its output shaft 79 in a self-contained manner, one or more of the main, secondary and auxiliary actuators 71, 72, 73, 74 can be provided with a connecting interface 77 for a removable connection with an external programming unit 300.

Practically the external programming unit 300 is a portable electronic device by means of which the contents of memories 75 of the individual actuators 71, 72, 73, 74 can be managed; in particular, through the portable device 300 the follow-up parameters 75*a* present in these memories 75 can be submitted to additions, deletions and/or variations, so that the machine 1 is correctly programmed depending on the features that are wished to be given to the finished product 40.

Preferably, all actuators 71, 72, 73, 74 are provided with a connecting interface 77 of the above described type.

The invention achieves important advantages.

First of all, by virtue of the above described type of control it is possible to minimise the risk of breakage of the yarns fed to the weaving members, since tension of same is regulated in a precise and reliable manner.

In addition, the quality of the obtained textile product is correspondingly improved, due to the fact that the amount of yarn fed to the weaving members is the amount really required for obtaining the desired geometries and aesthetic effects.

The invention claimed is:

1. A textile machine, comprising:

a main shaft (10) drivable in rotation;

a sensor (20) connected with said main shaft (10) to detect at least one angular position (PA) of said shaft and generate a corresponding reference signal (SR);

one or more weaving members (30) to be driven in synchronism with said main shaft (10) to make a textile product (40);

at least one beam (50) on which a yarn (60, 61, 63, 64) to be fed to said weaving members (30) is wound, to obtain said textile product (40);

actuating means (70) to drive said beam (50) in rotation and unwind said yarn (60, 61, 63, 64), control means (80) connected to said sensor (20) and said actuating means (70) to move said actuating means depending on said reference signal (SR).

2. A machine as claimed in claim 1, further comprising picking-up means (110, 120) to draw the yarn (60, 61, 63, 64) wound on said at least one beam (50).

3. A machine as claimed in claim 1, wherein said control means (80) comprises:

at least one memory device (75, 90) containing at least one follow-up parameter (PIP, 75*a*) representing a follow-up action between said actuating means (70) and main shaft (10);

comparison means (100, 76) to compare said at least one follow-up parameter with said reference signal (SR) and generate a corresponding command signal (SCP, 76*a*) for said actuating means (70), depending on said comparison.

4. A machine as claimed in claim 1, characterised in that it comprises a plurality of beams (50), each of them supporting one yarn (60, 61, 63, 64) to be fed to said weaving members (30) for making said textile product (40).

5. A machine as claimed in claim 4, characterised in that said actuating means (70) comprises a plurality of main actuators (71) that are each connected with a respective beam (50) for movement of the beam itself.

6. A machine as claimed in claim 1, characterised in that said textile product (40) comprises a plurality of fabric rows (40*a*) made after each other in succession by said weaving members (30).

7. A machine as claimed in claim 4, further comprising picking-up means (110, 120) to draw the yarn (60, 61, 63, 64) wound on said at least one beam (50), said picking-up means comprising one or more feeding members (110) interposed between said one or more beams (50) and weaving members (30) to adjust tension of the yarn (60, 61, 63, 64) unwound from the respective one of said beams (50).

8. A machine as claimed in claim 7, further comprising one or more secondary actuators (72) that are each connected with a respective feeding member (110) for movement of the feeding member itself.

9. A machine as claimed in claim 1, further comprising at least one take-down member (120) to draw out the product (40) made by said weaving members (30).

10. A machine as claimed in claim 9, further comprising a first auxiliary actuator (73) connected with said take-down member (120) for movement of the latter.

11. A machine as claimed in claim 1, further comprising a collecting device (130) to collect said textile product (40).

12. A machine as claimed in claim 11, further comprising a second auxiliary actuator (74) connected with said collecting device (130) for movement of the collecting device itself.

13. A machine as claimed in claim 5, wherein said control means (80) is provided with a control unit (81) connected to at least said sensor (20) and each of said main actuators (71) to send respective main command signals (SCP) said main actuators and adjust movement of said beams (50) depending on said reference signal (SR).

14. A textile machine as claimed in claim 13, wherein said control unit (81) supplies each of said main actuators (71) with a main command signal (SCP), depending on said reference signal (SR) for each of said fabric rows (40*a*).

15. A machine as claimed in claim 13, wherein one or more of said main command signals (SCP) is also generated depending on displacement of at least a predetermined one of said weaving members (30).

16. A textile machine as claimed in claim 15, wherein the main command signal (SCP) relating to a predetermined fabric row (40*a*) is generated depending on the displacement performed by said predetermined weaving member (30) at said predetermined fabric row (40*a*).

17. A machine as claimed in claim 15, wherein said predetermined weaving member (30) receives the yarn (60, 61, 63, 64) unwound from the beam (50) that is interlocked with the main actuator (71) receiving said main command signal (SCP).

18. A machine as claimed in claim 17, wherein said control unit (81) comprises said memory (90) and comparison means (100), said memory (90) having a plurality of records (91) that are each connected with a respective fabric row (40*a*) and provided with a plurality of main fields (92) each containing a respective main follow-up parameter (PIP), each main follow-up parameter (PIP) being associated with a respective main actuator (71) and representing a follow-up action between said respective main actuator (71) and said main shaft (10) at said respective fabric row (40*a*).

19. A machine as claimed in claim 18, wherein each record (91) further comprises at least one displacement field (99) containing a displacement parameter (PS) representing a displacement performed by at least one of said weaving members (30) to make the fabric row (40*a*) associated with said record (91).

20. A machine as claimed in claim 19, wherein said control unit (81) comprises calculation means (82) to calculate said main follow-up parameters (PIP).

21. A machine as claimed in claim 20, wherein said calculation means (82) comprises:

a comparator block (83) to compare the main follow-up parameter (PIP) belonging to a predetermined record (91) with the corresponding main follow-up parameter (PIP) belonging to a subsequent record;

correction means (84) to vary the main follow-up parameter (PIP) of said predetermined record (91) based on said comparison.

22. A machine as claimed in claim 13, wherein said control unit (81) is further connected to one or more secondary actuators (72) for controlled movement of said one or more feeding members (110) depending on said reference signal (SR).

23. A machine as claimed in claim 22, wherein said control unit (81) supplies one or more of said secondary actuators (72) with a secondary command signal (SCS) for each of said fabric rows (40*a*) of said product (40).

24. A machine as claimed in claim 18, wherein each record (91) of said memory (90) further comprises one or more secondary fields (93) each containing one secondary follow-up parameter (PIS) representing a follow-up action between a predetermined secondary actuator (72) and said main shaft (10).

25. A machine as claimed in claim 13, wherein said control unit (81) is further connected to a first auxiliary actuator (73) for controlled movement of said take-down member (120) depending on said reference signal (SR).

26. A machine as claimed in claim 25, wherein said control unit (81) supplies said first auxiliary actuator (73) with a first auxiliary command signal (SCA1) depending on said reference signal (SR) for each of said fabric rows (40*a*) of said product (40).

27. A machine as claimed in claim 18, wherein each record (91) of said memory (90) further comprises at least one first auxiliary field (94) to contain a first auxiliary follow-up parameter (PIA1) representing a follow-up action between a first auxiliary actuator (73) and main shaft (10).

28. A machine as claimed in claim 13, wherein said control unit (81) is further connected to a second auxiliary actuator (74) for movement of said collecting device (130) depending on said reference signal (SR).

29. A machine as claimed in claim 28, wherein said control unit (81) supplies said second auxiliary actuator (74) with a second auxiliary command signal (SCA2) depending on said reference signal (SR) for each of the fabric rows (40*a*) of said product (40).

30. A machine as claimed in claim 18, characterised in that each record (91) of said memory (90) further comprises a second auxiliary field (95) to contain a second auxiliary follow-up parameter (PIA2) representing a follow-up action betweein a second auxiliary actuator (74) and main shaft (10).

31. A machine as claimed in claim 5, wherein one or more of the predetermined actuators of said main, secondary, and auxiliary actuators (71, 72, 73, 74) comprises:

a memory (75) containing at least one follow-up parameter (75*a*) representing a follow-up action between said predetermined actuator (71, 72, 73, 74) and main shaft (10);

comparison means (76) connected to said sensor (20) and said memory (75) to compare said reference signal (SR) with said follow-up parameter (75*a*) and generate a corresponding command signal (76*a*) for movement of said predetermined actuator (71, 72, 73, 74) depending on said comparison.

32. A machine as claimed in claim 12, wherein each of said main, secondary, and auxiliary actuators (71, 72, 73, 74) comprises:

a memory (75) containing at least one follow-up parameter (75*a*) that is representative of a follow-up action between said actuator (71, 72, 73, 74) and main shaft (10);

comparison means (76) connected to said sensor (20) and memory (75) to compare said reference signal (SR) with said follow-up parameter (75*a*) and generate a corresponding command signal (76*a*) for movement of said actuator (71, 72, 73, 74) depending on said comparison.

33. A machine as claimed in claim 5, wherein one or more of said main, secondary, and auxiliary actuators (71, 72, 73, 74) are provided with a connecting interface (77) for removable connection with an external programming unit (300).

34. A machine as claimed in claim 5, wherein one or more of said actuators (71, 72, 73, 74) comprises an electric motor (78) provided with an output shaft (79) to be driven in rotation.

35. A machine as claimed in claim 1, wherein it is a crochet galloon machine (1*a*).

36. A machine as claimed in claim 35, wherein said weaving members (30) comprise at least one carrier slide bar (31), said main follow-up parameters (PIP) comprising first main follow-up parameters (PIP1) that are representative of a follow-up action between the main actuators (71) active on the beams (50) supplying said carrier slide bar (31) with weft yarns (60) and said main shaft (10), said first main follow-up parameters (PIP1) being preferably a function of a displacement of said carrier slide bar (31).

37. A machine as claimed in claim 36, wherein each record (91) of said memory (90) further comprises a displacement field (99) containing a displacement parameter (PS) that is representative of a displacement performed by said carrier slide bar (31) at the weft row (40*a*) associated with said record (91).

38. A machine as claimed in claim 37, wherein each first main follow-up parameter (PIP1) is a function of the displacement parameter (PS) belonging to the same record (91).

39. A machine as claimed in claim 38, wherein said calculation means (82) is adapted to calculate said first main follow-up parameters (PIP1).

40. A machine as claimed in claim 39, wherein said comparator block (83) is adapted to compare the first main follow-up parameter (PIP1) belonging to a predetermined record (91) with a corresponding first main follow-up parameter (PIP1) belonging to a subsequent record, said correction means (84) being adapted to vary, depending on said comparison, the first main follow-up parameter (PIP1) of said predetermined record (91).

41. A machine as claimed in claim 40, wherein said calculation means (81) further comprises a modification block (85) to vary said first main follow-up parameters (PIP1) depending on the elasticity of the weft yarns (60).

42. A machine as claimed in claim 35, wherein said weaving members (30) further comprise at least one guide bar (32), said main follow-up parameters also comprising second main follow-up parameters (PIP2) representing a follow-up action between the main actuators (71) active on the beams supplying said guide bar (32) with warp yarns and said main shaft (10), said second main follow-up parameters (PIP2) being preferably a function of an amount of warp yarn drawn by said take-down member (120) for each revolution of said main shaft (10).

43. A machine as claimed in claim 42, wherein said calculation means (82) is also adapted to calculate said second main follow-up parameters (PIP2).

44. A machine as claimed in claim 1, characterised in that it is a needle loom (1*b*).

45. A machine as claimed in claim 44, wherein said weaving members (30) comprise one or more heddles (33) supported by a predetermined number of frames (34), said main follow-up parameters (PIP) being a function of the displacements of said one or more heddles (33).

46. A machine as claimed in claim 45, wherein each record (91) of said memory (90) further comprises a displacement field (99) containing a displacement parameter (PS) that is representative of a displacement performed by said heddle (33) at the fabric row (40*a*) associated with said record (91).

47. A machine as claimed in claim 1, wherein it is a two-bed warp knitting machine (1*c*).

48. A machine as claimed in claim 47, wherein said weaving members (30) comprise at least one guide bar (35), said main follow-up parameters (PIP) being a function of the displacements of said guide bar (35).

49. A machine as claimed in claim 48, wherein each record (91) of said memory (90) further comprises a displacement field (99) containing a displacement parameter (PS) that is representative of a displacement performed by said guide bar (35) at the fabric row (40*a*) corresponding to said record (91).

* * * * *

UNITED STATES PATENT AND TRADEMARK OFFICE

CERTIFICATE OF CORRECTION

PATENT NO. : 7,475,570 B2
APPLICATION NO. : 11/342084
DATED : January 13, 2009
INVENTOR(S) : Luigi Omodeo Zorini It is certified that error appears in the above-identified patent and that said Letters Patent is hereby corrected as shown below:

Title Page, Item [57]
In the Abstract, line 11, after "actuator", please insert --to move the actuator--.

In column 22, line 12 (claim 13), after "(SCP)", please insert --to--.

Signed and Sealed this

Second Day of June, 2009

JOHN DOLL
*Acting Director of the United States Patent and Trademark Office*